US009454096B2

(12) United States Patent
Hasegawa et al.

(10) Patent No.: US 9,454,096 B2
(45) Date of Patent: Sep. 27, 2016

(54) MAGNETIC TONER

(71) Applicant: CANON KABUSHIKI KAISHA, Tokyo (JP)

(72) Inventors: Yusuke Hasegawa, Suntou-gun (JP); Tadashi Dojo, Numazu (JP); Michihisa Magome, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 8 days.

(21) Appl. No.: 14/364,067

(22) PCT Filed: Dec. 26, 2012

(86) PCT No.: PCT/JP2012/084287

§ 371 (c)(1),
(2) Date: Jun. 9, 2014

(87) PCT Pub. No.: WO2013/100183

PCT Pub. Date: Jul. 4, 2013

(65) Prior Publication Data

US 2014/0302433 A1 Oct. 9, 2014

(30) Foreign Application Priority Data

Dec. 27, 2011 (JP) ..... 2011-286201

(51) Int. Cl.
*G03G 9/083* (2006.01)
*G03G 9/08* (2006.01)
(Continued)

(52) U.S. Cl.
CPC ..... *G03G 9/0834* (2013.01); *G03G 9/081* (2013.01); *G03G 9/083* (2013.01); *G03G 9/0819* (2013.01);
(Continued)

(58) Field of Classification Search
CPC ..... G03G 9/0834; G03G 9/0819; G03G 9/0825; G03G 9/08795; G03G 9/0836; G03G 9/09725; G03G 9/0833
See application file for complete search history.

(56) References Cited

U.S. PATENT DOCUMENTS 5,066,558 A 11/1991 Hikake et al.
6,485,876 B1 11/2002 Takezawa et al.
(Continued)

FOREIGN PATENT DOCUMENTS

JP 2-167561 * 6/1990 ..... G03G 9/08
JP 8-12478 B2 2/1996
(Continued)

OTHER PUBLICATIONS

Translation of JP 2-167561 published Jun. 1990.*
(Continued)

*Primary Examiner* — Peter Vajda
(74) *Attorney, Agent, or Firm* — Fitzpatrick, Cella, Harper & Scinto

(57) ABSTRACT

A magnetic toner contains magnetic toner particles containing a binder resin and a magnetic body, and inorganic fine particles present on the surface of the magnetic toner particles, wherein the inorganic fine particles present on the surface of the magnetic toner particles contain metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A and a coverage ratio B/coverage ratio A in prescribed ranges, wherein the magnetic toner has a dielectric constant ∈' and a dielectric loss tangent in prescribed ranges.

6 Claims, 7 Drawing Sheets

(51) Int. Cl.
*G03G 9/087* (2006.01)
*G03G 9/097* (2006.01)

(52) U.S. Cl.
CPC ..... *G03G 9/0825* (2013.01); *G03G 9/0827* (2013.01); *G03G 9/0833* (2013.01); *G03G 9/0835* (2013.01); *G03G 9/0836* (2013.01); *G03G 9/08755* (2013.01); *G03G 9/08795* (2013.01); *G03G 9/09708* (2013.01); *G03G 9/09725* (2013.01)

(56) References Cited

U.S. PATENT DOCUMENTS

| | | | | |
|---|---|---|---|---|
| 2007/0072102 | A1* | 3/2007 | Dojo et al. | 430/106.1 |
| 2009/0233212 | A1* | 9/2009 | Fujikawa | G03G 9/0815 430/109.4 |
| 2012/0231382 | A1* | 9/2012 | Minagawa et al. | 430/105 |

FOREIGN PATENT DOCUMENTS

| | | | |
|---|---|---|---|
| JP | 10-48869 | A | 2/1998 |
| JP | 2001-117267 | A | 4/2001 |
| JP | 2001-305780 | A | 11/2001 |
| JP | 2005-134751 | A | 5/2005 |
| JP | 2006-52332 | A | 2/2006 |
| JP | 3812890 | B2 | 8/2006 |
| JP | 2007-293043 | A | 11/2007 |
| JP | 2008-40434 | A | 2/2008 |
| JP | 2009-229785 | A | 10/2009 |
| JP | 2010-282017 | A | 12/2010 |

OTHER PUBLICATIONS

Magome, et al., U.S. Appl. No. 14/364,068, filed Jun. 9, 2014.
Ohmori, et al. U.S. Appl. No. 14/364,633, filed Jun. 11, 2014.
Hiroko, et al., U.S. Appl. No. 14/364,065, filed Jun. 9, 2014.
Suzumura, et al., U.S. Appl. No. 14/362,380, filed Jun. 2, 2014.
Matsui, et al., U.S. Appl. No. 14/362,377, filed Jun. 2, 2014.
Sano, et al., U.S. Appl. No. 14/364,636, filed Jun. 11, 2014.
Uratani, et al., U.S. Appl. No. 14/364,634, filed Jun. 11, 2014.
Nomura, et al., U.S. Appl. No. 14/364,640, filed Jun. 11, 2014.
Tanaka, et al., U.S. Appl. No. 14/364,638, filed Jun. 11, 2014.
PCT International Search Report and Written Opinion of the International Searching Authority, International Application No. JP2012/084287, Mailing Date Mar. 12, 2013.

* cited by examiner

MAGNETIC TONER

TECHNICAL FIELD

The present invention relates to a magnetic toner for use in, for example, electrophotographic methods, electrostatic recording methods, and magnetic recording methods.

BACKGROUND ART

Image-forming apparatuses, e.g., copiers and printers, have in recent years been experiencing increasing diversification in their intended applications and use environments as well as demand for additional improvements in speed, image quality, and stability. For example, printers, which previously were used mainly in office environments, have also entered into use in severe environments, and the generation of stable images even under these circumstances has become critical.

Copiers and printers are also undergoing device downsizing and enhancements in energy efficiency, and magnetic monocomponent development systems that use a favorable magnetic toner are preferably used in this context.

In a magnetic monocomponent development system, development is carried out by transporting a magnetic toner into the development zone using a toner-carrying member (referred to below as a developing sleeve) that incorporates in its interior means of generating a magnetic field, e.g., a magnet roll. In addition, charge is imparted to the magnetic toner mainly by triboelectric charging brought about by rubbing between the magnetic toner and a triboelectric charge-providing member, for example, the developing sleeve. Reducing the size of the developing sleeve is an important technology in particular from the standpoint of reducing the size of the device.

When, for example, the raw materials are not satisfactorily dispersed in the magnetic toner, or during use in a severe environment, this triboelectric charging may not proceed uniformly and the magnetic toner may then become nonuniformly charged. As a result, development can occur in which only a portion of the magnetic toner is excessively charged, so-called charge-up, and various image defects may then occur.

In particular, when the developing sleeve has been downsized as referenced above, the development zone of the development nip region is narrowed and the flight of the magnetic toner from the developing sleeve is made more difficult. As a consequence, a portion of the magnetic toner is prone to remain on the developing sleeve and a trend of greater charging instability sets in.

For example, a reduction in image density can occur when charged-up toner remains on the developing sleeve, while an image defect such as fogging in the nonimage areas can be caused when the toner charge is nonuniform. Furthermore, in the case of use after standing at quiescence for a while, melt adhesion by the toner to the electrostatic latent image-bearing member may end up occurring in contact regions between the electrostatic latent image-bearing member and a member, such as the cleaning blade, that comes into contact with the electrostatic latent image-bearing member, and image defects, so-called "streaks", may then be produced at each rotation period of the electrostatic latent image-bearing member.

To counter these problems, a large number of techniques have been introduced for controlling the dielectric characteristics—which are an index for the state of dispersion of the magnetic body in a magnetic toner—in order to stabilize the variations in the developing performance associated with changes in the environment.

For example, in Patent Literature 1, the attempt is made to lower the variation in toner charging performance associated with environmental variations by controlling the dielectric loss tangent (tan δ) in high-temperature and normal temperature zones.

While in fact a certain effect is obtained under certain prescribed conditions, in particular a high degree of raw material dispersibility at a high magnetic body content is not adequately addressed, and there is still room for improvement in particular from the standpoint of the streaks.

In addition, in order to inhibit environmental variations in the toner, Patent Literature 2 discloses a toner in which the ratio between the saturation water content HL under low-temperature, low-humidity conditions and the saturation water content HH under high-temperature, high-humidity conditions has been brought into a prescribed range.

By controlling the water content in the indicated manner, a certain effect is in fact obtained under certain prescribed conditions for the image density reproducibility and the transfer behavior. However, the charging stability is in particular not addressed for the case in which the magnetic body has been incorporated in an amount corresponding to use as a colorant, and is inadequate for obtaining the effects of the present invention.

On the other hand, in order to solve the problems associated with external additives, toners have been disclosed with a particular focus on the release of external additives (refer to Patent Literatures 3 and 4). The charging stability of magnetic toners is again not adequately addressed in these cases.

Moreover, Patent Literature 5 teaches stabilization of the development•transfer steps by controlling the total coverage ratio of the toner base particles by the external additives, and a certain effect is in fact obtained by controlling the theoretical coverage ratio, provided by calculation, for a certain prescribed toner base particle. However, the actual state of binding by external additives may be substantially different from the value calculated assuming the toner to be a sphere, and, for magnetic toners in particular, achieving the effects of the present invention without controlling the actual state of external additive binding has proven to be entirely unsatisfactory.

CITATION LIST

[Patent Literature]

[PTL 1] Japanese Patent Application Publication No. 2005-134751

[PTL 2] Japanese Patent Application Publication No. 2009-229785

[PTL 3] Japanese Patent Application Publication No. 2001-117267

[PTL 4] Japanese Patent Publication No. 3812890

[PTL 5] Japanese Patent Application Publication No. 2007-293043

SUMMARY OF INVENTION

Technical Problems

An object of the present invention is to provide a magnetic toner that can solve the problems identified above.

Specially, an object of the present invention is to provide a magnetic toner that yields a stable image density regardless of the use environment and that can prevent the occurrence of fogging and streaks.

Solution to Problem

The present inventors discovered that the problems can be solved by specifying the relationship between the coverage ratio of the magnetic toner particles' surface by the inorganic fine particles and the coverage ratio of the magnetic toner particles' surface by inorganic fine particles that are fixed to the magnetic toner particles' surface and by specifying the dielectric characteristics of the magnetic toner. The present invention was achieved based on this discovery.

Thus, the present invention is described as follows:

a magnetic toner comprising magnetic toner particles comprising a binder resin and a magnetic body, and inorganic fine particles present on the surface of the magnetic toner particles, wherein the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of at least 0.50 and not more than 0.85, and wherein the magnetic toner has a dielectric constant $\in'$, at a frequency of 100 kHz and a temperature of 30° C., of at least 30.0 pF/m and not more than 40.0 pF/m and has a dielectric loss tangent (tan δ) of not more than $9.0\times10^{-3}$.

Advantageous Effects of Invention

The present invention can provide a magnetic toner that, regardless of the use environment, yields a stable image density and can prevent the occurrence of fogging and streaks.

DESCRIPTION OF EMBODIMENTS

Figure 1:
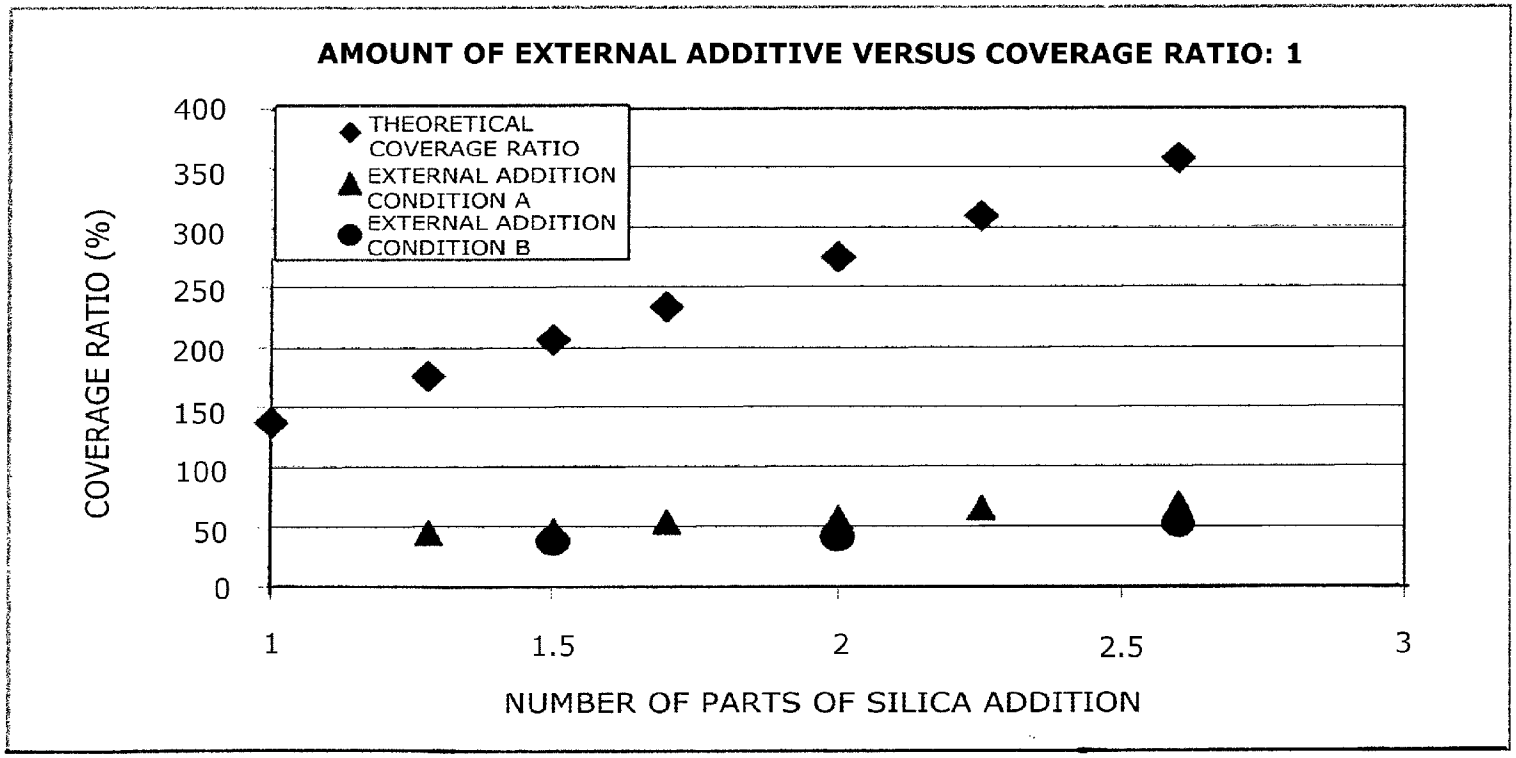
FIG. 1 is a diagram that shows an example of the relationship between the number of parts of silica addition and the coverage ratio.

The present invention is described in detail below.

The present invention relates to a magnetic toner comprising magnetic toner particles containing a binder resin and a magnetic body, and inorganic fine particles present on the surface of the magnetic toner particles, wherein;

the inorganic fine particles present on the surface of the magnetic toner particles contain metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles;

letting the coverage ratio A (%) be the coverage ratio of the magnetic toner particles' surface by the inorganic fine particles and letting the coverage ratio B (%) be the coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of at least 0.50 and not more than 0.85; and the magnetic toner has a dielectric constant $\in'$, at a frequency of 100 kHz and a temperature of 30° C., of at least 30.0 pF/m and not more than 40.0 pF/m and has a dielectric loss tangent (tan δ) of not more than $9.0\times10^{-3}$.

According to investigations by the present inventors, the use of the above-described magnetic toner can provide a stable image density regardless of the use environment and can suppress the generation of fogging and streaks.

Here, the generation of "streaks" is hypothesized to be caused as follows.

During the production of a large number of prints, charged-up magnetic toner attaches to the tip of the cleaning blade that removes the magnetic toner present on the electrostatic latent image-bearing member. When copying is finished in this condition, standing then occurs in a state in which agglomerates of the magnetic toner are pressed into the electrostatic latent image-bearing member by the pressure of the nip region.

When copying is resumed while in this state, magnetic toner, which should normally be removed by the cleaning blade, slips past the blade due to the melt adhesion to the electrostatic latent image-bearing member.

In addition, when the electrostatic latent image-bearing member makes one revolution and the cleaning blade again approaches the region where magnetic toner has undergone melt adhesion, the coefficient of friction of the electrostatic latent image-bearing member changes from that for a region where toner is not melt-adhered and the stable rotation of the electrostatic latent image-bearing member is hindered as a result.

A charge defect is formed in the longitudinal direction of the electrostatic latent image-bearing member due to this hindered rotation, and this results in "streaks", which are a streak-shaped image defect, at each rotation period of the electrostatic latent image-bearing member.

Thus, when large amounts of charged-up toner are present, magnetic toner will then readily attach to the cleaning blade and the magnetic toner attached to the cleaning blade undergoes melt-adhesion to the electrostatic latent image-bearing member and the streaks worsen. Moreover, when a large number of prints are output or when image output is carried out in a high-temperature, high-humidity environment, melt adhesion by the magnetic toner to the electrostatic latent image-bearing member occurs even more readily and as a consequence the production of streaks becomes substantial.

Furthermore, in an apparatus that uses a small-diameter developing sleeve in order to achieve size reduction, the developing sleeve has a large curvature and a narrow developing zone then occurs in the development nip region; the flight of the magnetic toner from the developing sleeve is made more difficult as a consequence; the charged-up toner undergoes an increase; and streaks are even more readily produced.

Suppressing the generation of charged-up toner is effective for suppressing streaks. While many techniques for reducing charged-up tone have already been proposed, these techniques have not been satisfactory with regard to suppressing "streaks". In particular, it has not been possible to adequately suppress streaks when a large number of prints are output in a high-temperature, high-humidity environment using an apparatus that uses a small-diameter developing sleeve.

As a result of their investigations, the present inventors discovered that the charged-up toner can be substantially reduced with a magnetic toner that has prescribed dielectric characteristics and a prescribed state of external addition for the inorganic fine particles, and that as a result the generation of streaks can be suppressed.

It is critical for the magnetic toner of the present invention that the dielectric constant $\in'$ at a frequency of 100 kHz and a temperature of 30° C. be at least 30.0 pF/m and not more than 40.0 pF/m and that the dielectric loss tangent (tan δ) be not more than $9.0\times10^{-3}$.

A frequency of 100 kHz is set here as a condition for measuring the dielectric constant because this is an optimal frequency for examining the state of dispersion of the magnetic body. When the frequency is lower than 100 kHz, it becomes difficult to perform stable measurements and the ability to distinguish differences in the dielectric constant of the magnetic toner will tend to be lost. In addition, values about the same as at 100 kHz were consistently obtained when measurements were carried out at 120 kHz. When the frequency was not lower than this, a trend set up in which the difference in the dielectric constant between magnetic toners with different properties was somewhat small. The reason for setting the measurement temperature to 30° C. is that this was thought to be a temperature representative of the temperature within the cartridge during image printing.

To achieve these dielectric characteristics, adjustments can be made based on, for example, the selection of the binder resin, the acid value of the magnetic toner, and the content of the magnetic body.

For example, the dielectric constant $\in'$ can be brought to a relatively high value and is easily controlled into the above-described range by using a large polyester component content for the binder resin in the magnetic toner.

In addition, the dielectric constant $\in'$ can be lowered by lowering the acid value of the resin component of the magnetic toner or by lowering the content of the magnetic body in the magnetic toner; conversely, the dielectric constant $\in'$ can be raised by raising the acid value of the resin component or by increasing the content of the magnetic body in the magnetic toner.

On the other hand, the dielectric loss tangent (tan δ) can be lowered by a uniform dispersion of the magnetic body in the magnetic toner. For example, a uniform dispersion of the magnetic body can be promoted by lowering the viscosity of the kneaded material by raising the kneading temperature during melt kneading (at least 160° C.)

Specifying a relatively large dielectric constant $\in'$ in the range of the present invention is thought to establish dielectric characteristics at which the magnetic toner is easily charged. In addition, setting a relatively low dielectric loss tangent (tan δ) is thought to establish a suppression of charge leakage due to a very uniform dispersion of the magnetic body in the magnetic toner. That is, it is thought that the simultaneous control of the dielectric constant $\in'$ and the dielectric loss tangent (tan δ) provides the properties of facile charging and resistance to charge leakage and makes it possible for the magnetic toner to undergo rapid charging.

The magnetic toner of the present invention preferably has a dielectric constant $\in'$, at a frequency of 100 kHz and a temperature of 30° C., of at least 32.0 pF/m and not more than 38.0 pF/m and preferably has a dielectric loss tangent (tan δ) of not more than $8.5\times10^{-3}$.

Moreover, letting the coverage ratio A (%) be the coverage ratio of the magnetic toner particles' surface by the inorganic fine particles and letting the coverage ratio B (%) be the coverage ratio of the magnetic toner particles' surface by the inorganic fine particles that are fixed to the magnetic toner particles' surface, it is critical for the magnetic toner of the present invention that the coverage ratio A be at least 45.0% and not more than 70.0% and that the ratio [coverage ratio B/coverage ratio A, also referred to below simply as B/A] of the coverage ratio B to the coverage ratio A be at least 0.50 and not more than 0.85.

The coverage ratio A is preferably at least 45.0% and not more than 65.0% and B/A is preferably at least 0.55 and not more than 0.80.

By having the coverage ratio A and B/A, which indicate the state of external addition, satisfy prescribed ranges in the magnetic toner having a rapid charging performance as described above, it becomes possible for the first time to substantially reduce the charged-up toner and suppress "streaks".

While the reasons for this are not entirely clear, the following is hypothesized.

During the development step, the magnetic toner comes into contact with the developing blade and the developing sleeve in the contact region between the developing blade and developing sleeve and is charged by friction at this time. As a consequence, when magnetic toner remains on the developing sleeve and/or at the developing blade without undergoing development, it is subjected to repeated charging and charge up is produced.

However, since, with the magnetic toner of the present invention, the coverage ratio A of the magnetic toner particles' surface by the inorganic fine particles has a high value of at least 45.0%, the van der Waals forces and electrostatic forces with the contact members are low and the ability of the magnetic toner to remain in proximity to the developing sleeve and developing blade is suppressed. The inorganic fine particles must be added in large amounts in order to bring the coverage ratio A above 70.0%, but, even if an external addition method could be devised here, image defects (vertical streaks) brought about by released inorganic fine particles are then readily produced and this is therefore disfavored.

This coverage ratio A, coverage ratio B, and ratio [B/A] of the coverage ratio B to the coverage ratio A can be determined by the methods described below.

The coverage ratio A used in the present invention is a coverage ratio that also includes the easily-releasable inorganic fine particles, while the coverage ratio B is the coverage ratio due to inorganic fine particles that are fixed to the magnetic toner particle surface and are not released in the release process described below. It is thought that the inorganic fine particles represented by the coverage ratio B are fixed in a semi-embedded state in the magnetic toner particle surface and therefore do not undergo displacement even when the magnetic toner is subjected to shear on the developing sleeve or on the electrostatic latent image-bearing member.

The inorganic fine particles represented by the coverage ratio A, on the other hand, include the fixed inorganic fine particles described above as well as inorganic fine particles that are present in the upper layer and have a relatively high degree of freedom.

As noted above, it is thought that the inorganic fine particles that can be present between magnetic toner particles and between the magnetic toner and the various members participate in bringing about the effect of diminished van der Waals forces and diminished electrostatic forces and that having a high coverage ratio A is particularly critical with regard to this effect.

First, the van der Waals force (F) produced between a flat plate and a particle is represented by the following equation.

$$F=H\times D/(12Z^2)$$

Here, H is Hamaker's constant, D is the diameter of the particle, and Z is the distance between the particle and the flat plate.

With respect to Z, it is generally held that an attractive force operates at large distances and a repulsive force operates at very small distances, and Z is treated as a constant since it is unrelated to the state of the magnetic toner particle surface.

According to the preceding equation, the van der Waals force (F) is proportional to the diameter of the particle in contact with the flat plate. When this is applied to the magnetic toner surface, the van der Waals force (F) is smaller for an inorganic fine particle, with its smaller particle size, in contact with the flat plate than for a magnetic toner particle in contact with the flat plate. That is, the van der Waals force is smaller for the case of contact through the intermediary of the inorganic fine particles provided as an external additive than for the case of direct contact between the magnetic toner particle and the developing sleeve or developing blade.

Furthermore, the electrostatic force can be regarded as a reflection force. It is known that a reflection force is directly proportional to the square of the particle charge (q) and is inversely proportional to the square of the distance.

In the case of the charging of a magnetic toner, it is the surface of the magnetic toner particle and not the inorganic fine particles that bear the charge. Due to this, the reflection force declines as the distance between the surface of the magnetic toner particle and the flat plate (here, the developing sleeve or developing blade) grows larger.

That is, when, in the case of the magnetic toner surface, the magnetic toner particle comes into contact with the flat plate through the intermediary of the inorganic fine particles, a distance is set up between the flat plate and the surface of the magnetic toner particle and the reflection force is lowered as a result.

As described in the preceding, the van der Waals force and reflection force produced between the magnetic toner and the developing sleeve or developing blade are reduced by having inorganic fine particles be present at the magnetic toner particle surface and having the magnetic toner come into contact with the developing sleeve or developing blade with the inorganic fine particles interposed therebetween. That is, the attachment force between the magnetic toner and the developing sleeve or developing blade is reduced.

Whether the magnetic toner particle directly contacts the developing sleeve or developing blade or is in contact therewith through the intermediary of the inorganic fine particles, depends on the amount of inorganic fine particles coating the magnetic toner particle surface, i.e., on the coverage ratio by the inorganic fine particles.

It is thought that the opportunity for direct contact between the magnetic toner particles and the developing sleeve or developing blade is diminished at a high coverage ratio by the inorganic fine particles, which makes it more difficult for the magnetic toner to stick to the developing sleeve or developing blade. On the other hand, the magnetic toner readily sticks to the developing sleeve or developing blade at a low coverage ratio by the inorganic fine particles and is prone to remain on the developing sleeve or in proximity to the developing blade.

With regard to the coverage ratio by the inorganic fine particles, a theoretical coverage ratio can be calculated—making the assumption that the inorganic fine particles and the magnetic toner have a spherical shape—using the equation described, for example, in Patent Literature 5. However, there are also many instances in which the inorganic fine particles and/or the magnetic toner do not have a spherical shape, and in addition the inorganic fine particles may also be present in an aggregated state on the toner particle surface. As a consequence, the theoretical coverage ratio derived using the indicated technique does not pertain to the present invention.

The present inventors therefore carried out observation of the magnetic toner surface with the scanning electron microscope (SEM) and determined the coverage ratio for the actual coverage of the magnetic toner particle surface by the inorganic fine particles.

Figure 2:
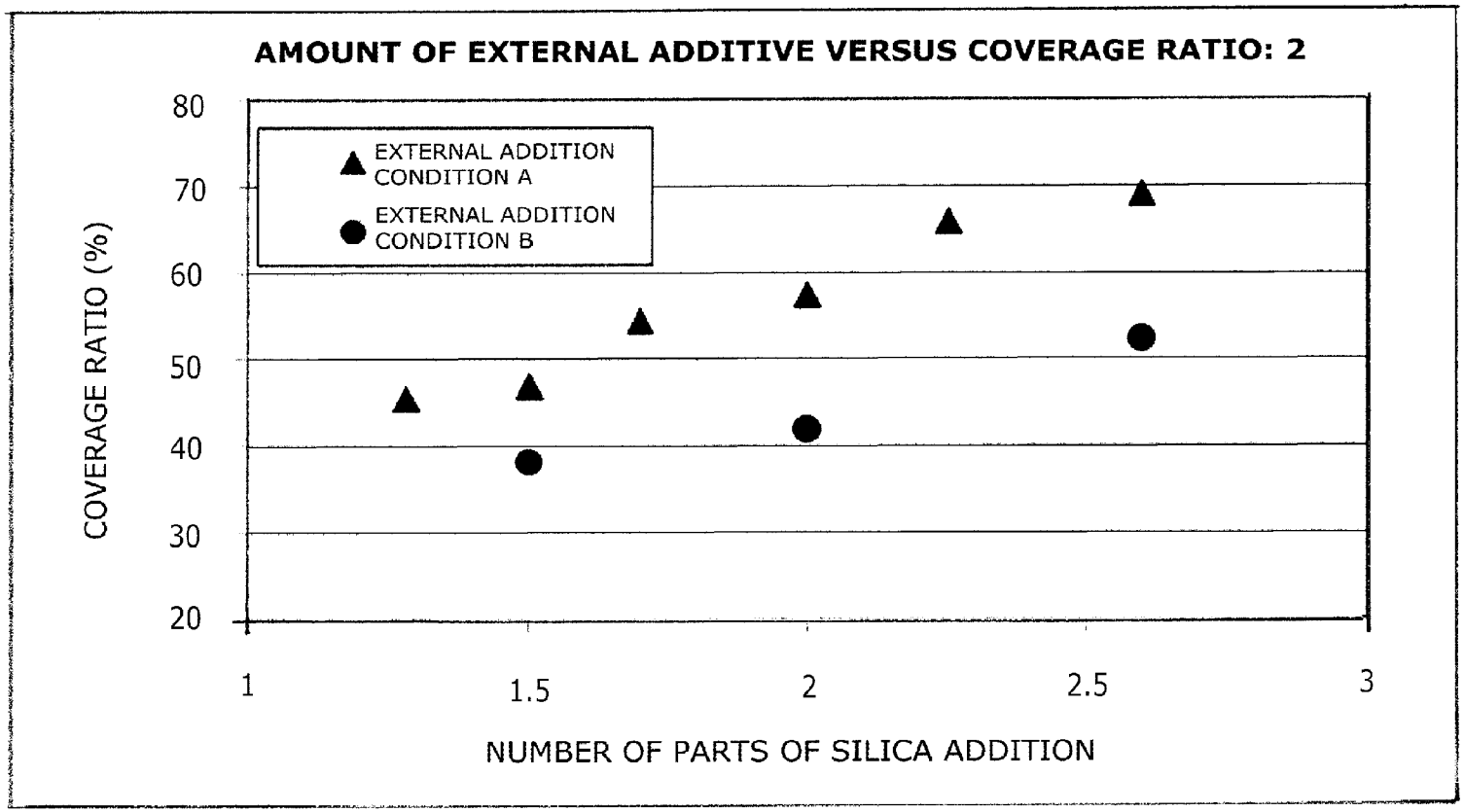
FIG. 2 is a diagram that shows an example of the relationship between the number of parts of silica addition and the coverage ratio.

As one example, the theoretical coverage ratio and the actual coverage ratio were determined for mixtures prepared by adding different amounts of silica fine particles (number of parts of silica addition) to 100 mass parts of magnetic toner particles (magnetic body content=43.5 mass %) provided by a pulverization method and having a volume-average particle diameter (Dv) of 8.0 μm (refer to FIGS. 1 and 2). Silica fine particles with a volume-average particle diameter (Dv) of 15 nm were used for the silica fine particles.

For the calculation of the theoretical coverage ratio, 2.2 $g/cm^3$ was used for the true specific gravity of the silica fine particles; 1.65 $g/cm^3$ was used for the true specific gravity of the magnetic toner; and monodisperse particles with a particle diameter of 15 nm and 8.0 μm were assumed for, respectively, the silica fine particles and the magnetic toner particles.

As shown in FIG. 1, the theoretical coverage ratio exceeds 100% as the amount of addition of the silica fine particles is increased. On the other hand, the actual coverage ratio does vary with the amount of addition of the silica fine particles, but does not exceed 100%. This is due to silica fine particles being present to some degree as aggregates on the magnetic toner surface or is due to a large effect from the silica fine particles not being spherical.

Moreover, according to investigations by the present inventors, it was found that, even at the same amount of addition by the silica fine particles, the coverage ratio varied with the external addition technique. That is, it is not possible to determine the coverage ratio uniquely from the amount of addition of the silica fine particles (refer to FIG. 2). Here, external addition condition A refers to mixing at 1.0 W/g for a processing time of 5 minutes using the apparatus shown in FIG. 4. External addition condition B refers to mixing at 4000 rpm for a processing time of 2 minutes using an FM10C Henschel mixer (from Mitsui Miike Chemical Engineering Machinery Co., Ltd.).

For the reasons provided in the preceding, the present inventors used the inorganic fine particle coverage ratio obtained by SEM observation of the magnetic toner surface.

In addition, as has been noted above, it is thought that the attachment force to a member can be reduced by raising the coverage ratio by the inorganic fine particles. Tests were therefore carried out on the attachment force with a member and the coverage ratio by the inorganic fine particles.

The relationship between the coverage ratio for the magnetic toner and the attachment force with a member was indirectly inferred by measuring the static friction coefficient between an aluminum substrate and spherical polystyrene particles having different coverage ratios by silica fine particles.

Specifically, the relationship between the coverage ratio and the static friction coefficient was determined using spherical polystyrene particles (weight-average particle diameter (D4)=7.5 μm) that had different coverage ratios (coverage ratio determined by SEM observation) by silica fine particles.

Figure 3:
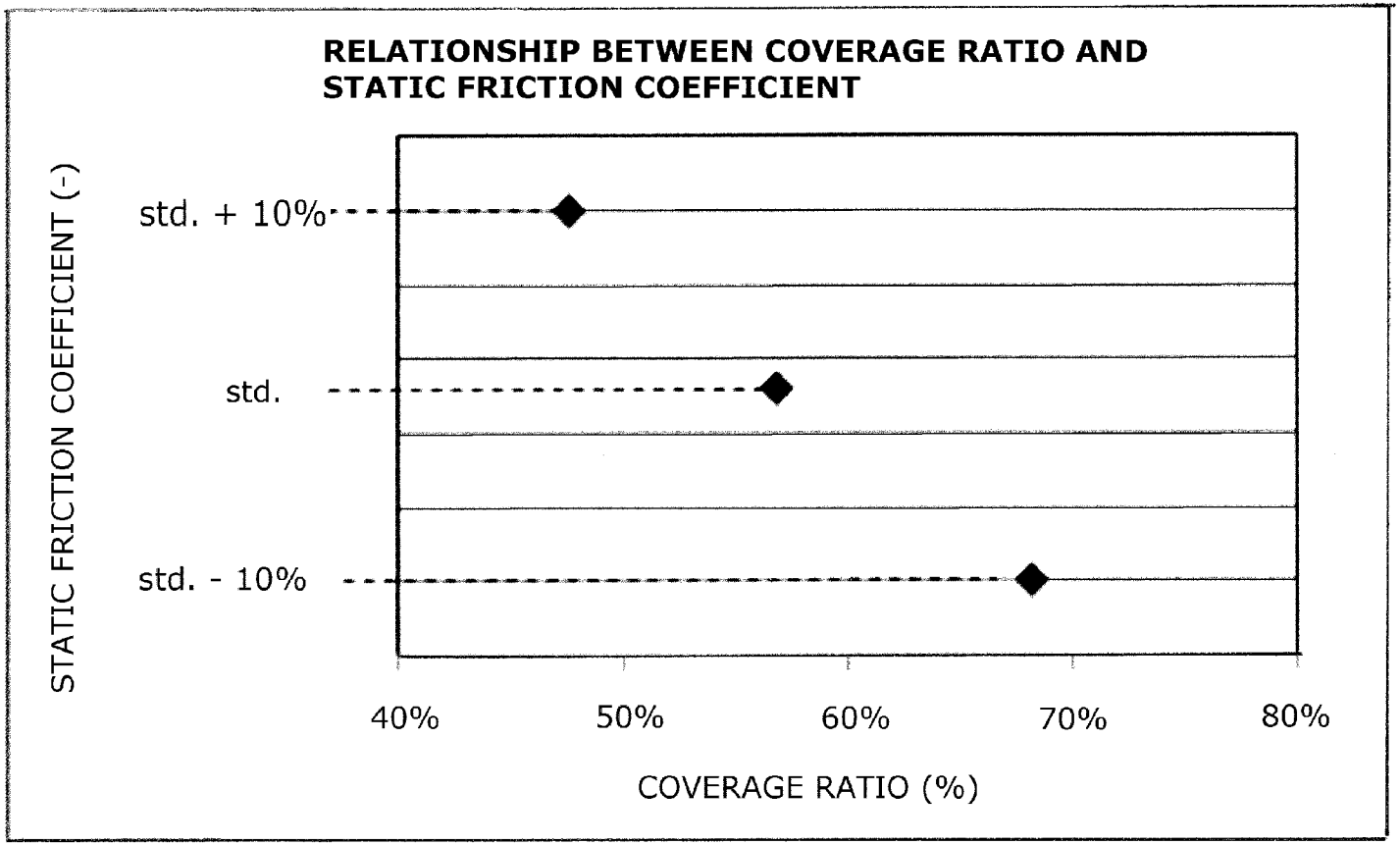
FIG. 3 is a diagram that shows an example of the relationship between the coverage ratio and the static friction coefficient.

More specifically, spherical polystyrene particles to which silica fine particles had been added were pressed onto an aluminum substrate. The substrate was moved to the left and right while changing the pressing pressure, and the static friction coefficient was calculated from the resulting stress. This was performed for the spherical polystyrene particles at each different coverage ratio, and the obtained relationship between the coverage ratio and the static friction coefficient is shown in FIG. 3.

The static coefficient of fraction determined by the preceding technique is thought to correlate with the sum of the van der Waals and reflection forces acting between the spherical polystyrene particles and the substrate. According to FIG. 3, a trend appears in which the static friction coefficient declines as the coverage ratio by the silica fine particles increases. That is, it is inferred that a magnetic toner having a high coverage rate by inorganic fine particles also has a low attachment force for a member.

When the present inventors carried out intensive investigations based on these results, the streaks could be suppressed by controlling the coverage rate by the inorganic fine particles and by controlling the dielectric characteristics of the magnetic toner.

As has been described above, inhibiting the production of charged-up magnetic toner is critical for suppressing the appearance of streaks. Relative to this, the van der Waals and reflection forces produced between the magnetic toner and the developing sleeve or developing blade can be lowered by setting a high value for the coverage ratio A and bringing the magnetic toner particles into contact across inorganic fine particles with the developing sleeve or developing blade. As a result, the attachment force between the magnetic toner and the developing sleeve or developing blade is lowered; the magnetic toner can then be prevented from remaining on the developing sleeve or at the developing blade without undergoing development; and the generation of streaks can thereby be substantially suppressed.

On the other hand, even if charged-up magnetic toner capable of temporarily attaching to the cleaning blade should be present in some small amount on the developing sleeve or at the developing blade, the attachment force between the magnetic toner and the cleaning blade can be lowered by the high coverage ratio A of the magnetic toner, and as a consequence attachment of the magnetic toner to the tip of the cleaning blade can be prevented.

That B/A is from at least 0.50 to not more than 0.85 means that inorganic fine particles fixed to the magnetic toner particle surface are present to a certain degree and that in addition inorganic fine particles in a readily releasable state (a state that enables behavior separated from the magnetic toner particle) are also present thereon in a favorable amount. It is thought that a bearing-like effect is generated presumably by the releasable inorganic fine particles sliding against the fixed inorganic fine particles and that the aggregative forces between the magnetic toners are then substantially reduced.

According to the results of investigations by the present inventors, it was found that this bearing effect and the above-described attachment force-reducing effect are maximally obtained when both the fixed inorganic fine particles and the easily releasable inorganic fine particles are relatively small inorganic fine particles having a primary particle number-average particle diameter (D1) of approximately not more than 50 nm. Accordingly, the coverage ratio A and the coverage ratio B were calculated focusing on the inorganic fine particles having a primary particle number-average particle diameter (D1) of not more than 50 nm.

By setting prescribed ranges for the coverage ratio A and B/A for the magnetic toner of the present invention, the attachment force between the magnetic toner and various members can be reduced and the aggregative forces between the magnetic toners can be substantially diminished. As a result, an increased opportunity for contact between each individual magnetic toner particle and the developing blade and developing sleeve can be provided in the region of contact between the developing blade and developing sleeve, and due to this a very efficient charging is made possible for the first time in the case of the magnetic toner having the dielectric characteristics described above. As a consequence, charged-up toner, which is readily produced at a reduced-diameter developing sleeve, can in particular be substantially reduced.

The coefficient of variation on the coverage ratio A is preferably not more than 10.0% in the present invention. The coefficient of variation on the coverage ratio A is more preferably not more than 8.0%. The specification of a coefficient of variation on the coverage ratio A of not more than 10.0% means that the coverage ratio A is very uniform between magnetic toner particles and within magnetic toner particle. When the coefficient of variation exceeds 10.0%, the state of coverage of the magnetic toner surface is nonuniform, which impairs the ability to lower the aggregative forces between the toners.

There are no particular limitations on the technique for bringing the coefficient of variation to 10.0% or below, but the use is preferred of the external addition apparatus and technique described below, which are capable of bringing about a high degree of spreading of the metal oxide fine particles, e.g., silica fine particles, over the magnetic toner particles' surface.

The binder resin for the magnetic toner in the present invention can be exemplified by vinyl resins, polyester resins, epoxy resins, polyurethane resins, and so forth, but is not particularly limited and the heretofore known resins can be used. Among the preceding, a polyester resin or a vinyl resin is preferably present from the standpoint of the compatibility between the charging performance and the fixing performance, while the use of a polyester resin as the main binder resin is particularly preferred from the standpoint of controlling the dielectric characteristics (particularly the dielectric constant ∈') into the range of the present invention. The composition of this polyester resin is as described in the following.

The divalent alcohol component constituting the polyester resin can be exemplified by ethylene glycol, propylene glycol, butanediol, diethylene glycol, triethylene glycol, pentanediol, hexanediol, neopentyl glycol, hydrogenated bisphenol A, bisphenols with the following formula (A) and their derivatives, and diols with the following formula (B).

[Chem 1]

(A)

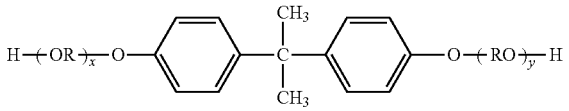

(In the formula, R is an ethylene group or propylene group; x and y are each integers greater than or equal to 0; and the average value of x+y is greater than or equal to 0 and less than or equal to 10.)

[Chem 2]

(B)

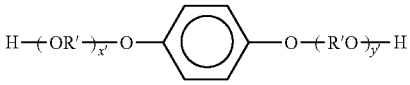

(In the formula, R' is

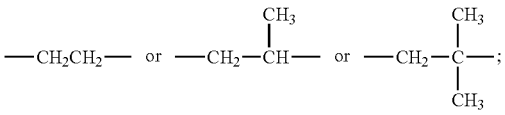

x' and y' are integers greater than or equal to 0; and the average value of x'+y' is greater than or equal to 0 and less than or equal to 10.)

The divalent acid component constituting this polyester resin can be exemplified by benzenedicarboxylic acids such as phthalic acid, terephthalic acid, isophthalic acid, and phthalic anhydride; alkyldicarboxylic acids such as succinic acid, adipic acid, sebacic acid, and azelaic acid; alkenylsuccinic acids such as n-dodecenylsuccinic acid; and unsaturated dicarboxylic acids such as fumaric acid, maleic acid, citraconic acid, and itaconic acid.

A trivalent or higher valent alcohol component by itself or a trivalent or higher valent acid component by itself may be used as a crosslinking component, or both may be used in combination.

The trivalent or higher valent polyvalent alcohol component can be exemplified by sorbitol, pentaerythritol, dipentaerythritol, tripentaerythritol, butanetriol, pentanetriol, glycerol, methylpropanetriol, trimethylolethane, trimethylolpropane, and trihydroxybenzene.

The trivalent or higher valent polyvalent carboxylic acid component in the present invention can be exemplified by trimellitic acid, pyromellitic acid, benzenetricarboxylic acid, butanetricarboxylic acid, hexanetricarboxylic acid, and tetracarboxylic acids with the following formula (C).

[Chem 3]

(C)

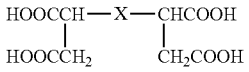

(X in the formula represents a $C_{5-30}$ alkylene group or alkenylene group that has at least one side chain that contains at least three carbons.)

The binder resin may contain a styrene resin within a range in which the dielectric properties and so forth according to the present invention are satisfied.

The contained styrene resin can be specifically exemplified by polystyrene and by styrene copolymers such as styrene-propylene copolymers, styrene-vinyltoluene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-octyl methacrylate copolymers, styrene-butadiene copolymers, styrene-isoprene copolymers, styrene-maleic acid copolymers, and styrene-maleate copolymers. A single one of these may be used or a plurality may be used in combination.

The glass-transition temperature (Tg) of the magnetic toner of the present invention is preferably from at least 40° C. to not more than 70° C. When the glass-transition temperature is from at least 40° C. to not more than 70° C., the storage stability and durability can be enhanced while maintaining a favorable fixing performance.

The acid value, as measured by dissolving the magnetic toner of the present invention in a mixed solvent of toluene and ethanol and performing the measurement on the resulting soluble matter using a potentiometric titration apparatus, is preferably from at least 5 mg KOH/g to not more than 50 mg KOH/g and more preferably is from at least 10 mg KOH/g to not more than 40 mg KOH/g. Controlling the acid value into the indicated range facilitates adjustment to the dielectric characteristics specified by the present invention for the magnetic toner. In order to control this acid value into the indicated range, the acid value of the binder resin used in the present invention is preferably from at least 5 mg KOH/g to not more than 50 mg KOH/g. The details of the method for measuring the acid value are given below.

When this acid value for the magnetic toner is less than 5 mg KOH/g, the dielectric constant ∈' is prone to be too small and the magnetic toner also tends to charge up easily.

When this acid value for the magnetic toner exceeds 50 mg KOH/g, the dielectric constant ∈' is prone to be too large and a trend also appears wherein the density declines— depending on the image output environment—because the hygroscopicity readily increases.

The magnetic toner of the present invention may as necessary also incorporate a wax in order to improve the fixing performance. Any known wax can be used for this wax. Specific examples are petroleum waxes, e.g., paraffin wax, microcrystalline wax, and petrolatum, and their derivatives; montan waxes and their derivatives; hydrocarbon waxes provided by the Fischer-Tropsch method and their derivatives; polyolefin waxes, as typified by polyethylene and polypropylene, and their derivatives; natural waxes, e.g., carnauba wax and candelilla wax, and their derivatives; and ester waxes. Here, the derivatives include oxidized products, block copolymers with vinyl monomers, and graft modifications. In addition, the ester wax can be a monofunctional ester wax or a multifunctional ester wax, e.g., most prominently a difunctional ester wax but also a tetrafunctional or hexafunctional ester wax.

When a wax is incorporated in the magnetic toner of the present invention, its content is preferably from at least 0.5 mass parts to not more than 10 mass parts per 100 mass parts of the binder resin. When the wax content is in the indicated range, the fixing performance is enhanced while the storage stability of the magnetic toner is not impaired.

The wax can be incorporated in the binder resin by, for example, a method in which, during resin production, the resin is dissolved in a solvent, the temperature of the resin solution is raised, and addition and mixing are carried out while stirring, or a method in which addition is carried out during melt kneading during production of the magnetic toner.

The peak temperature (also referred to below as the melting point) of the maximum endothermic peak measured on the wax using a differential scanning calorimeter (DSC) is preferably from at least 60° C. to not more than 140° C. and more preferably is from at least 70° C. to not more than 130° C. When the peak temperature (melting point) of the maximum endothermic peak is from at least 60° C. to not more than 140° C., the magnetic toner is easily plasticized during fixing and the fixing performance is enhanced. This is also preferred because it works against the appearance of outmigration by the wax even during long-term storage.

The peak temperature of the maximum endothermic peak of the wax is measured in the present invention based on ASTM D3418-82 using a "Q1000" differential scanning calorimeter (TA Instruments, Inc.). Temperature correction in the instrument detection section is carried out using the melting points of indium and zinc, while the heat of fusion of indium is used to correct the amount of heat.

Specifically, approximately 10 mg of the measurement sample is precisely weighed out and this is introduced into an aluminum pan. Using an empty aluminum pan as the reference, the measurement is performed at a rate of temperature rise of 10° C./min in the measurement temperature range from 30 to 200° C. For the measurement, the temperature is raised to 200° C. at 10° C./min and is then dropped to 30° C. at 10° C./min and is thereafter raised again at 10° C./min. The peak temperature of the maximum endothermic peak is determined for the wax from the DSC curve in the temperature range of 30 to 200° C. for this second temperature ramp-up step.

The magnetic body present in the magnetic toner in the present invention can be exemplified by iron oxides such as magnetite, maghemite, ferrite, and so forth; metals such as iron, cobalt, and nickel; and alloys and mixtures of these metals with metals such as aluminum, copper, magnesium, tin, zinc, beryllium, calcium, manganese, selenium, titanium, tungsten, and vanadium.

The number-average particle diameter (D1) of the primary particles of this magnetic body is preferably not more than 0.50 μm and more preferably is from 0.05 μm to 0.30 μm.

This magnetic body preferably has the following magnetic properties for the magnetic field application of 795.8 kA/m: a coercive force ($H_c$) preferably from 1.6 to 12.0 kA/m; a intensity of magnetization ($\sigma_s$) preferably from 50 to 200 $Am^2/kg$ and more preferably from 50 to 100 $Am^2/kg$; and a residual magnetization ($\sigma_r$) preferably from 2 to 20 $Am^2/kg$.

The magnetic toner of the present invention preferably contains from at least 35 mass % to not more than 50 mass % of the magnetic body and more preferably contains from at least 40 mass % to not more than 50 mass %.

Control to the dielectric properties specified by the present invention is easily brought about by having the content of the magnetic body in the magnetic toner be in the indicated range.

The content of the magnetic body in the magnetic toner can be measured using a Q50001R TGA thermal analyzer from PerkinElmer Inc. With regard to the measurement method, the magnetic toner is heated from normal temperature to 900° C. under a nitrogen atmosphere at a rate of temperature rise of 25° C./minute: the mass loss from 100 to 750° C. is taken to be the component provided by subtracting the magnetic body from the magnetic toner and the residual mass is taken to be the amount of the magnetic body.

A charge control agent is preferably added to the magnetic toner of the present invention. The magnetic toner of the present invention is preferably a negative-charging toner.

Organometal complex compounds and chelate compounds are effective as charging agents for negative charging and can be exemplified by monoazo-metal complex compounds; acetylacetone-metal complex compounds; and metal complex compounds of aromatic hydroxycarboxylic acids and aromatic dicarboxylic acids.

Specific examples of commercially available products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used or two or more may be used in combination. Considered from the standpoint of the amount of charging of the magnetic toner, these charge control agents are used, expressed per 100 mass parts of the binder resin, preferably at from 0.1 to 10.0 mass parts and more preferably at from 0.1 to 5.0 mass parts.

The magnetic toner of the present invention contains inorganic fine particles at the magnetic toner particles' surface.

The inorganic fine particles present on the magnetic toner particles' surface can be exemplified by silica fine particles, titania fine particles, and alumina fine particles, and these inorganic fine particles can also be favorably used after the execution of a hydrophobic treatment on the surface thereof.

It is critical that the inorganic fine particles present on the surface of the magnetic toner particles in the present invention contain at least one of metal oxide fine particle selected from the group consisting of silica fine particles, titania fine particles, and alumina fine particles, and that at least 85 mass % of the metal oxide fine particles be silica fine particles. Preferably at least 90 mass % of the metal oxide fine particles are silica fine particles. The reasons for this are that silica fine particles not only provide the best balance with regard to imparting charging performance and flowability, but are also excellent from the standpoint of lowering the aggregative forces between the toners.

The reason why silica fine particles are excellent from the standpoint of lowering the aggregative forces between the toners are not entirely clear, but it is hypothesized that this is probably due to the substantial operation of the previously described bearing effect with regard to the sliding behavior between the silica fine particles.

In addition, silica fine particles are preferably the main component of the inorganic fine particles fixed to the magnetic toner particle surface. Specifically, the inorganic fine particles fixed to the magnetic toner particle surface preferably contain at least one of metal oxide fine particle selected from the group consisting of silica fine particles, titania fine particles, and alumina fine particles wherein silica fine particles are at least 80 mass % of these metal oxide fine particles. The silica fine particles are more preferably at least 90 mass %. This is hypothesized to be for the same reasons as discussed above: silica fine particles are the best from the standpoint of imparting charging performance and flowability, and as a consequence a rapid initial rise in magnetic toner charge occurs. The result is that a high image density can be obtained, which is strongly preferred.

Here, the timing and amount of addition of the inorganic fine particles may be adjusted in order to bring the silica fine particles to at least 85 mass % of the metal oxide fine particles present on the magnetic toner particle surface and in order to also bring the silica fine particles to at least 80 mass % with reference to the metal oxide particles fixed on the magnetic toner particle surface.

The amount of inorganic fine particles present can be checked using the methods described below for quantitating the inorganic fine particles.

The number-average particle diameter (D1) of the primary particles in the inorganic fine particles in the present invention is preferably from at least 5 nm to not more than 50 nm and more preferably is from at least 10 nm to not more than 35 nm.

Bringing the number-average particle diameter (D1) of the primary particles in the inorganic fine particles into the indicated range facilitates favorable control of the coverage ratio A and B/A and facilitates the generation of the above-described bearing effect and attachment force-reducing effect.

A hydrophobic treatment is preferably carried out on the inorganic fine particles used in the present invention, and particularly preferred inorganic fine particles will have been hydrophobically treated to a hydrophobicity, as measured by the methanol titration test, of at least 40% and more preferably at least 50%.

The method for carrying out the hydrophobic treatment can be exemplified by methods in which treatment is carried out with, e.g., an organosilicon compound, a silicone oil, a long-chain fatty acid, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these can be used or a mixture of two or more can be used.

The silicone oil can be exemplified by dimethylsilicone oil, methylphenylsilicone oil, α-methylstyrene-modified silicone oil, chlorophenyl silicone oil, and fluorine-modified silicone oil.

A $C_{10-22}$ fatty acid is suitably used for the long-chain fatty acid, and the long-chain fatty acid may be a straight-chain fatty acid or a branched fatty acid. A saturated fatty acid or an unsaturated fatty acid may be used.

Among the preceding, $C_{10-22}$ straight-chain saturated fatty acids are highly preferred because they readily provide a uniform treatment of the surface of the inorganic fine particles.

These straight-chain saturated fatty acids can be exemplified by capric acid, lauric acid, myristic acid, palmitic acid, stearic acid, arachidic acid, and behenic acid.

Inorganic fine particles that have been treated with silicone oil are preferred for the inorganic fine particles used in the present invention, and inorganic fine particles treated with an organosilicon compound and a silicone oil are more preferred. This makes possible a favorable control of the hydrophobicity.

The method for treating the inorganic fine particles with a silicone oil can be exemplified by a method in which the silicone oil is directly mixed, using a mixer such as a Henschel mixer, with inorganic fine particles that have been treated with an organosilicon compound, and by a method in which the silicone oil is sprayed on the inorganic fine particles. Another example is a method in which the silicone oil is dissolved or dispersed in a suitable solvent; the inorganic fine particles are then added and mixed; and the solvent is removed.

In order to obtain a good hydrophobicity, the amount of silicone oil used for the treatment, expressed per 100 mass parts of the inorganic fine particles, is preferably from at least 1 mass parts to not more than 40 mass parts and is more preferably from at least 3 mass parts to not more than 35 mass parts.

In order to impart an excellent flowability to the magnetic toner, the silica fine particles, titania fine particles, and alumina fine particles used by the present invention have a specific surface area as measured by the BET method based on nitrogen adsorption (BET specific surface area) preferably of from at least 20 $m^2/g$ to not more than 350 $m^2/g$ and more preferably of from at least 25 $m^2/g$ to not more than 300 $m^2/g$.

Measurement of the specific surface area (BET specific surface area) by the BET method based on nitrogen adsorption is performed based on JIS Z8830 (2001). A "TriStar300 (Shimadzu Corporation) automatic specific surface area•pore distribution analyzer", which uses gas adsorption by a constant volume technique as its measurement procedure, is used as the measurement instrument.

The amount of addition of the inorganic fine particles, expressed per 100 mass parts of the magnetic toner particles, is preferably from at least 1.5 mass parts to not more than 3.0 mass parts of the inorganic fine particles, more preferably from at least 1.5 mass parts to not more than 2.6 mass parts, and even more preferably from at least 1.8 mass parts to not more than 2.6 mass parts.

Setting the amount of addition of the inorganic fine particles in the indicated range is also preferred from the standpoint of facilitating appropriate control of the coverage ratio A and B/A and also from the standpoint of the image density and fogging.

Exceeding 3.0 mass parts for the amount of addition of the inorganic fine particles, even if an external addition apparatus and an external addition method could be devised, gives rise to release of the inorganic fine particles and facilitates the appearance of, for example, a streak on the image.

In addition to the above-described inorganic fine particles, particles with a primary particle number-average particle diameter (D1) of from at least 80 nm to not more than 3 μm may be added to the magnetic toner of the present invention. For example, a lubricant, e.g., a fluororesin powder, zinc stearate powder, or polyvinylidene fluoride powder; a polish, e.g., a cerium oxide powder, a silicon carbide powder, or a strontium titanate powder; or a spacer particle such as silica, may also be added in small amounts that do not influence the effects of the present invention.

<Quantitation Methods for the Inorganic Fine Particles>

(1) Determination of the content of silica fine particles in the magnetic toner (standard addition method)

3 g of the magnetic toner is introduced into an aluminum ring having a diameter of 30 mm and a pellet is prepared using a pressure of 10 tons. The silicon (Si) intensity is determined (Si intensity-1) by wavelength-dispersive x-ray fluorescence analysis (XRF). The measurement conditions are preferably optimized for the XRF instrument used and all of the intensity measurements in a series are performed using the same conditions. Silica fine particles with a primary particle number-average particle diameter of 12 nm are added to the magnetic toner at 1.0 mass % with reference to the magnetic toner and mixing is carried out with a coffee mill.

For the silica fine particles admixed at this time, silica fine particles with a primary particle number-average particle diameter of from at least 5 nm to not more than 50 nm can be used without affecting this determination.

After mixing, pellet fabrication is carried out as described above and the Si intensity (Si intensity-2) is determined also as described above. Using the same procedure, the Si intensity (Si intensity-3, Si intensity-4) is also determined for samples prepared by adding and mixing the silica fine particles at 2.0 mass % and 3.0 mass % of the silica fine particles with reference to the magnetic toner. The silica content (mass %) in the magnetic toner based on the standard addition method is calculated using Si intensities-1 to −4.

The titania content (mass %) in the magnetic toner and the alumina content (mass %) in the magnetic toner are determined using the standard addition method and the same procedure as described above for the determination of the silica content. That is, for the titania content (mass %), titania fine particles with a primary particle number-average particle diameter of from at least 5 nm to not more than 50 nm are added and mixed and the determination can be made by determining the titanium (Ti) intensity. For the alumina content (mass %), alumina fine particles with a primary particle number-average particle diameter of from at least 5 nm to not more than 50 nm are added and mixed and the determination can be made by determining the aluminum (Al) intensity.

(2) Separation of the inorganic fine particles from the magnetic toner 5 g of the magnetic toner is weighed using a precision balance into a lidded 200-mL plastic cup; 100 mL methanol is added; and dispersion is carried out for 5 minutes using an ultrasound disperser. The magnetic toner is held using a neodymium magnet and the supernatant is discarded. The process of dispersing with methanol and discarding the supernatant is carried out three times, followed by the addition of 100 mL of 10% NaOH and several drops of "Contaminon N" (a 10 mass % aqueous solution of a neutral pH 7 detergent for cleaning precision measurement instrumentation and comprising a nonionic surfactant, an anionic surfactant, and an organic builder, from Wako Pure Chemical Industries, Ltd.), light mixing, and then standing at quiescence for 24 hours. This is followed by re-separation using a neodymium magnet. Repeated washing with distilled water is carried out at this point until NaOH does not remain. The recovered particles are thoroughly dried using a vacuum drier to obtain particles A. The externally added silica fine particles are dissolved and removed by this process. Titania fine particles and alumina fine particles can remain present in particles A since they are sparingly soluble in 10% NaOH.

(3) Measurement of the Si intensity in the particles A 3 g of the particles A are introduced into an aluminum ring with a diameter of 30 mm; a pellet is fabricated using a pressure of 10 tons; and the Si intensity (Si intensity-5) is determined by wavelength-dispersive XRF. The silica content (mass %) in particles A is calculated using the Si intensity-5 and the Si intensities-1 to −4 used in the determination of the silica content in the magnetic toner.

(4) Separation of the magnetic body from the magnetic toner 100 mL of tetrahydrofuran is added to 5 g of the particles A with thorough mixing followed by ultrasound dispersion for 10 minutes. The magnetic body is held with a magnet and the supernatant is discarded. This process is performed 5 times to obtain particles B. This process can almost completely remove the organic component, e.g., resins, outside the magnetic body. However, because a tetrahydrofuran-insoluble matter in the resin can remain, the particles B provided by this process are preferably heated to 800° C. in order to burn off the residual organic component, and the particles C obtained after heating are approximately the magnetic body that was present in the magnetic toner.

Measurement of the mass of the particles C yields the magnetic body content W (mass %) in the magnetic toner. In order to correct for the increment due to oxidation of the magnetic body, the mass of particles C is multiplied by 0.9666 ($Fe_2O_3 \rightarrow Fe_3O_4$).

(5) Measurement of the Ti intensity and Al intensity in the separated magnetic body Ti and Al may be present as impurities or additives in the magnetic body. The amount of Ti and Al attributable to the magnetic body can be detected by FP quantitation in wavelength-dispersive XRF. The detected amounts of Ti and Al are converted to titania and alumina and the titania content and alumina content in the magnetic body are then calculated.

The amount of externally added silica fine particles, the amount of externally added titania fine particles, and the amount of externally added alumina fine particles are calculated by substituting the quantitative values obtained by the preceding procedures into the following formulas.

amount of externally added silica fine particles (mass %)=silica content (mass %) in the magnetic toner−silica content (mass %) in particle A amount of externally added titania fine particles (mass %)=titania content (mass %) in the magnetic toner−{titania content (mass %) in the magnetic body×magnetic body content $W/100$} amount of externally added alumina fine particles (mass %)=alumina content (mass %) in the magnetic toner−{alumina content (mass %) in the magnetic body×magnetic body content $W/100$}

(6) Calculation of the Proportion of Silica Fine particles in the metal oxide fine particles selected from the group consisting of silica fine particles, titania fine particles, and alumina fine particles, for the inorganic fine particles fixed to the magnetic toner particle surface After carrying out the procedure, "Removing the unfixed inorganic fine particles", in the method described below for calculating the coverage ratio B and thereafter drying the toner, the proportion of the silica fine particles in the metal oxide fine particles can be calculated by carrying out the same procedures as in the method of (1) to (5) described above.

Viewed from the standpoint of the balance between the developing performance and the fixing performance, the weight-average particle diameter (D4) of the magnetic toner of the present invention is preferably from at least 6.0 μm to not more than 10.0 μm and more preferably is from at least 7.0 μm to not more than 9.0 μm.

In addition, viewed from the standpoint of suppressing charge up, the average circularity of the magnetic toner of the present invention is preferably from at least 0.935 to not more than 0.955 and is more preferably from at least 0.938 to not more than 0.950.

The average circularity of the magnetic toner of the present invention can be adjusted into the indicated range by adjusting the method of producing the magnetic toner and by adjusting the production conditions.

Examples of methods for producing the magnetic toner of the present invention are provided below, but there is no intent to limit the production method to these.

The magnetic toner of the present invention can be produced by any known method that enables adjustment of the coverage ratio A and B/A and that preferably has a step in which the average circularity can be adjusted, while the other production steps are not particularly limited.

The following method is a favorable example of such a production method. First, the binder resin and magnetic body and as necessary other raw materials, e.g., a wax and a charge control agent, are thoroughly mixed using a mixer such as a Henschel mixer or ball mill and are then melted, worked, and kneaded using a heated kneading apparatus such as a roll, kneader, or extruder to compatibilize the resins with each other.

The obtained melted and kneaded material is cooled and solidified and then coarsely pulverized, finely pulverized, and classified, and the external additives, e.g., inorganic fine particles, are externally added and mixed into the resulting magnetic toner particles to obtain the magnetic toner.

The mixer used here can be exemplified by the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); Loedige Mixer (Matsubo Corporation); and Nobilta (Hosokawa Micron Corporation).

The aforementioned kneading apparatus can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The aforementioned pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Among the preceding, the average circularity can be controlled by adjusting the exhaust gas temperature during micropulverization using a Turbo Mill. A lower exhaust gas temperature (for example, no more than 40° C.) provides a smaller value for the average circularity while a higher exhaust gas temperature (for example, around 50° C.) provides a higher value for the average circularity.

The aforementioned classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

Figure 4:
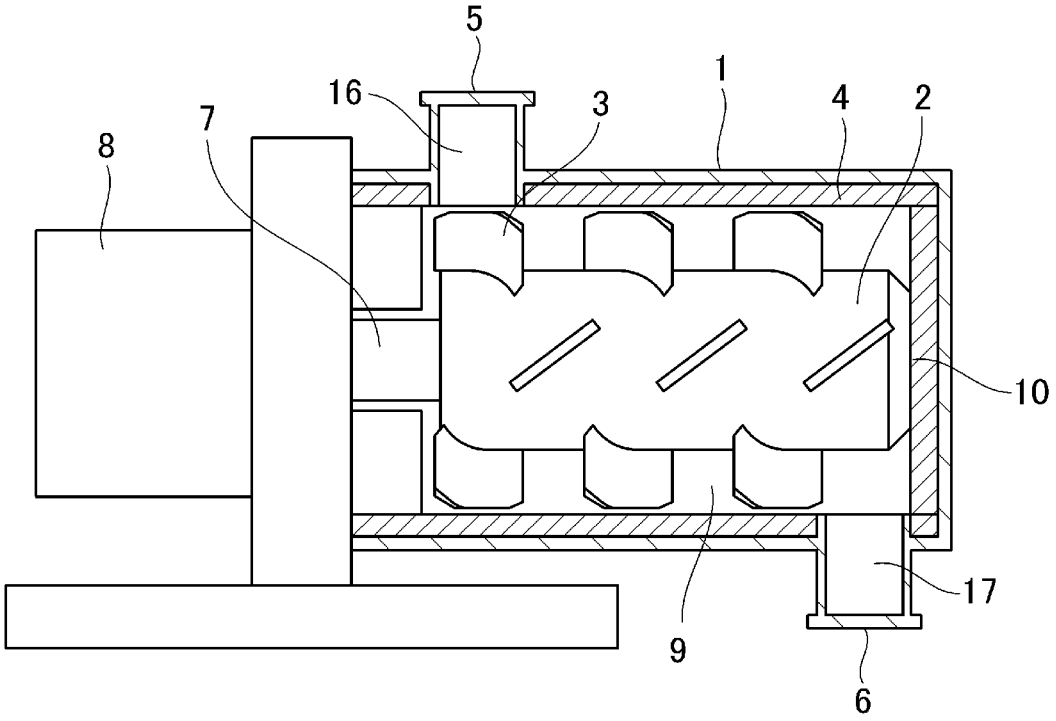
FIG. 4 is a schematic diagram that shows an example of a mixing process apparatus that can be used for the external addition and mixing of inorganic fine particles.

A known mixing process apparatus, e.g., the mixers described above, can be used for the external addition and mixing of the inorganic fine particles; however, an apparatus as shown in FIG. 4 is preferred from the standpoint of enabling facile control of the coverage ratio A, B/A, and the coefficient of variation on the coverage ratio A.

FIG. 4 is a schematic diagram that shows an example of a mixing process apparatus that can be used to carry out the external addition and mixing of the inorganic fine particles used by the present invention.

This mixing process apparatus readily brings about fixing of the inorganic fine particles to the magnetic toner particle surface because it has a structure that applies shear in a narrow clearance region to the magnetic toner particles and the inorganic fine particles.

Furthermore, as described below, the coverage ratio A, B/A, and coefficient of variation on the coverage ratio A are easily controlled into the ranges preferred for the present invention because circulation of the magnetic toner particles and inorganic fine particles in the axial direction of the rotating member is facilitated and because a thorough and uniform mixing is facilitated prior to the development of fixing.

Figure 5:
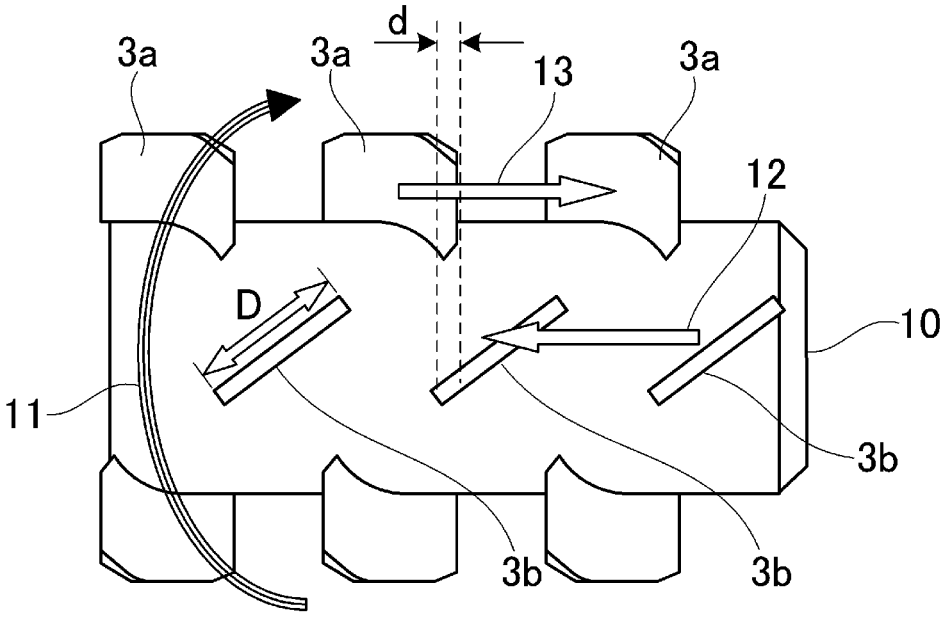
FIG. 5 is a schematic diagram that shows an example of the structure of a stirring member used in the mixing process apparatus.

On the other hand, FIG. 5 is a schematic diagram that shows an example of the structure of the stirring member used in the aforementioned mixing process apparatus.

The external addition and mixing process for the inorganic fine particles is described below using FIGS. 4 and 5.

This mixing process apparatus that carries out external addition and mixing of the inorganic fine particles has a rotating member 2, on the surface of which at least a plurality of stirring members 3 are disposed; a drive member 8, which drives the rotation of the rotating member; and a main casing 1, which is disposed to have a gap with the stirring members 3.

It is important that the gap (clearance) between the inner circumference of the main casing 1 and the stirring member 3 be maintained constant and very small in order to apply a uniform shear to the magnetic toner particles and facilitate the fixing of the inorganic fine particles to the magnetic toner particle surface.

The diameter of the inner circumference of the main casing 1 in this apparatus is not more than twice the diameter of the outer circumference of the rotating member 2. In FIG. 4, an example is shown in which the diameter of the inner circumference of the main casing 1 is 1.7-times the diameter of the outer circumference of the rotating member 2 (the trunk diameter provided by subtracting the stirring member 3 from the rotating member 2). When the diameter of the inner circumference of the main casing 1 is not more than twice the diameter of the outer circumference of the rotating member 2, impact force is satisfactorily applied to the magnetic toner particles since the processing space in which forces act on the magnetic toner particles is suitably limited.

In addition, it is important that the aforementioned clearance be adjusted in conformity to the size of the main casing. Viewed from the standpoint of the application of adequate shear to the magnetic toner particles, it is important that the clearance be made from about at least 1% to not more than 5% of the diameter of the inner circumference of the main casing 1. Specifically, when the diameter of the inner circumference of the main casing 1 is approximately 130 mm, the clearance is preferably made approximately from at least 2 mm to not more than 5 mm; when the diameter of the inner circumference of the main casing 1 is about 800 mm, the clearance is preferably made approximately from at least 10 mm to not more than 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

As shown in FIG. 5, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when the raw material inlet port 5 and the product discharge port 6 are disposed at the two ends of the main casing 1, as in FIG. 4, the direction toward the product discharge port 6 from the raw material inlet port 5 (the direction to the right in FIG. 4) is the "forward direction".

That is, as shown in FIG. 5, the face of the forward transport stirring member 3*a* is tilted so as to transport the magnetic toner particles in the forward direction (13). On the other hand, the face of the back transport stirring member 3*b* is tilted so as to transport the magnetic toner particles and the inorganic fine particles in the back direction (12).

By doing this, the external addition of the inorganic fine particles to the surface of the magnetic toner particles and mixing are carried out while repeatedly performing transport in the "forward direction" (13) and transport in the "back direction" (12).

In addition, with regard to the stirring members 3*a*, 3*b*, a plurality of members disposed at intervals in the circumferential direction of the rotating member 2 form a set. In the example shown in FIG. 5, two members at an interval of 180° with each other form a set of the stirring members 3*a*, 3*b* on the rotating member 2, but a larger number of members may form a set, such as three at an interval of 120° or four at an interval of 90°.

In the example shown in FIG. 5, a total of twelve stirring members 3*a*, 3*b* are formed at an equal interval.

Furthermore, D in FIG. 5 indicates the width of a stirring member and d indicates the distance that represents the overlapping portion of a stirring member. In FIG. 5, D is preferably a width that is approximately from at least 20% to not more than 30% of the length of the rotating member 2, when considered from the standpoint of bringing about an efficient transport of the magnetic toner particles and inorganic fine particles in the forward direction and back direction. FIG. 5 shows an example in which D is 23%. Furthermore, with regard to the stirring members 3*a* and 3*b*, when an extension line is drawn in the perpendicular direction from the location of the end of the stirring member 3*a*, a certain overlapping portion d of the stirring member with the stirring member 3*b* is preferably present. This serves to efficiently apply shear to the magnetic toner particles. This d is preferably from at least 10% to not more than 30% of D from the standpoint of the application of shear.

In addition to the shape shown in FIG. 5, the blade shape may be—insofar as the magnetic toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 4 and 5.

The apparatus shown in FIG. 4 has a rotating member 2, which has at least a plurality of stirring members 3 disposed on its surface; a drive member 8 that drives the rotation of the rotating member 2; a main casing 1, which is disposed forming a gap with the stirring members 3; and a jacket 4, in which a heat transfer medium can flow and which resides on the inside of the main casing 1 and at the end surface 10 of the rotating member.

In addition, the apparatus shown in FIG. 4 has a raw material inlet port 5, which is formed on the upper side of the main casing 1 for the purpose of introducing the magnetic toner particles and the inorganic fine particles, and a product discharge port 6, which is formed on the lower side of the main casing 1 for the purpose of discharging, from the main casing to the outside, the magnetic toner that has been subjected to the external addition and mixing process.

The apparatus shown in FIG. 4 also has a raw material inlet port inner piece 16 inserted in the raw material inlet port 5 and a product discharge port inner piece 17 inserted in the product discharge port 6.

In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2.

The sequence of introduction may also be introduction of the inorganic fine particles through the raw material inlet port 5 first and then introduction of the magnetic toner particles through the raw material inlet port 5. In addition, the magnetic toner particles and the inorganic fine particles may be mixed in advance using a mixer such as a Henschel mixer and the mixture may thereafter be introduced through the raw material inlet port 5 of the apparatus shown in FIG. 4.

More specifically, with regard to the conditions for the external addition and mixing process, controlling the power of the drive member 8 to from at least 0.2 W/g to not more than 2.0 W/g is preferred in terms of obtaining the coverage ratio A, B/A, and coefficient of variation on the coverage ratio A specified by the present invention. Controlling the power of the drive member 8 to from at least 0.6 W/g to not more than 1.6 W/g is more preferred.

When the power is lower than 0.2 W/g, it is difficult to obtain a high coverage ratio A, and B/A tends to be too low. On the other hand, B/A tends to be too high when 2.0 W/g is exceeded.

The processing time is not particularly limited, but is preferably from at least 3 minutes to not more than 10 minutes. When the processing time is shorter than 3 minutes, B/A tends to be low and a large coefficient of variation on the coverage ratio A is prone to occur. On the other hand, when the processing time exceeds 10 minutes, B/A conversely tends to be high and the temperature within the apparatus is prone to rise.

The rotation rate of the stirring members during external addition and mixing is not particularly limited; however, when, for the apparatus shown in FIG. 4, the volume of the processing space 9 in the apparatus is $2.0\times10^{-3}$ $m^3$, the rpm of the stirring members—when the shape of the stirring members 3 is as shown in FIG. 5—is preferably from at least 1000 rpm to not more than 3000 rpm. The coverage ratio A, B/A, and coefficient of variation on the coverage ratio A as specified for the present invention are readily obtained at from at least 1000 rpm to not more than 3000 rpm.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result a high coverage ratio A is readily obtained and the coefficient of variation on the coverage ratio A is readily reduced.

More specifically, the pre-mixing processing conditions are preferably a power of the drive member 8 of from at least 0.06 W/g to not more than 0.20 W/g and a processing time of from at least 0.5 minutes to not more than 1.5 minutes. It is difficult to obtain a satisfactorily uniform mixing in the pre-mixing when the loaded power is below 0.06 W/g or the processing time is shorter than 0.5 minutes for the pre-mixing processing conditions. When, on the other hand, the loaded power is higher than 0.20 W/g or the processing time is longer than 1.5 minutes for the pre-mixing processing conditions, the inorganic fine particles may become fixed to the magnetic toner particle surface before a satisfactorily uniform mixing has been achieved.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 6:
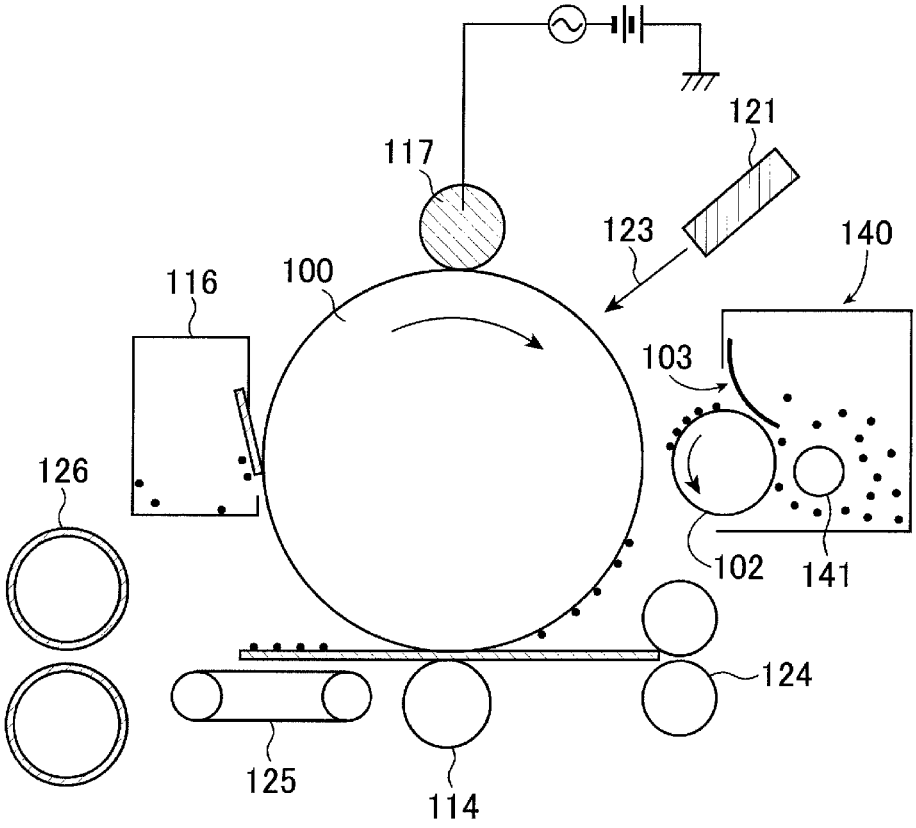
FIG. 6 is a diagram that shows an example of an image-forming apparatus.

An example of an image-forming apparatus that can advantageously use the magnetic toner of the present invention is specifically described below with reference to FIG. 6. In FIG. 6, 100 is an electrostatic latent image-bearing member (also referred to below as a photosensitive member), and the following, inter alia, are disposed on its circumference: a charging member (charging roller) 117, a developing device 140 having a toner-carrying member 102, a transfer member (transfer charging roller) 114, a cleaner container 116, a fixing unit 126, and a pick-up roller 124. The electrostatic latent image-bearing member 100 is charged by the charging roller 117. Photoexposure is performed by irradiating the electrostatic latent image-bearing member 100 with laser light from a laser generator 121 to form an electrostatic latent image corresponding to the intended image. The electrostatic latent image on the electrostatic latent image-bearing member 100 is developed by the developing device 140 with a monocomponent toner to provide a toner image, and the toner image is transferred onto a transfer material by the transfer roller 114, which contacts the electrostatic latent image-bearing member with the transfer material interposed therebetween. The toner image-bearing transfer material is conveyed to the fixing unit 126 and fixing on the transfer material is carried out. In addition, the magnetic toner remaining to some extent on the electrostatic latent image-bearing member is scraped off by the cleaning blade and is stored in the cleaner container 116.

The methods for measuring the various properties referenced by the present invention are described below.

<Calculation of the Coverage Ratio A>

The coverage ratio A is calculated in the present invention by analyzing, using Image-Pro Plus ver. 5.0 image analysis software (Nippon Roper Kabushiki Kaisha), the image of the magnetic toner surface taken with Hitachi's S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the magnetic toner is sprayed onto this. Additional blowing with air is performed to remove excess magnetic toner from the specimen stub and carry out thorough drying. The specimen stub is set in the specimen holder and the specimen stub height is adjusted to 36 mm with the specimen height gauge.

(2) Setting the Conditions for Observation with the S-4800

The coverage ratio A is calculated using the image obtained by backscattered electron imaging with the S-4800. The coverage ratio A can be measured with excellent accuracy using the backscattered electron image because the inorganic fine particles are charged up less than is the case with the secondary electron image.

Introduce liquid nitrogen to the brim of the anti-contamination trap located in the S-4800 housing and allow to stand for 30 minutes. Start the "PC-SEM" of the S-4800 and perform flashing (the FE tip, which is the electron source, is cleaned). Click the acceleration voltage display area in the control panel on the screen and press the [flashing] button to open the flashing execution dialog. Confirm a flashing intensity of 2 and execute. Confirm that the emission current due to flashing is 20 to 40 μA. Insert the specimen holder in the specimen chamber of the S-4800 housing. Press [home] on the control panel to transfer the specimen holder to the observation position.

Click the acceleration voltage display area to open the HV setting dialog and set the acceleration voltage to [0.8 kV] and the emission current to [20 μA]. In the [base] tab of the operation panel, set signal selection to [SE]; select [upper (U)] and [+BSE] for the SE detector; and select [L.A. 100] in the selection box to the right of [+BSE] to go into the observation mode using the backscattered electron image. Similarly, in the [base] tab of the operation panel, set the probe current of the electron optical system condition block to [Normal]; set the focus mode to [UHR]; and set WD to [3.0 mm]. Push the [ON] button in the acceleration voltage display area of the control panel and apply the acceleration voltage.

(3) Calculation of the Number-Average Particle Diameter (D1) of the Magnetic Toner Set the magnification to 5000× (5 k) by dragging within the magnification indicator area of the control panel. Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus with the autofocus. Focus by repeating this operation an additional two times.

After this, determine the number-average particle diameter (D1) by measuring the particle diameter at 300 magnetic toner particles. The particle diameter of the individual particle is taken to be the maximum diameter when the magnetic toner particle is observed.

(4) Focus Adjustment

For particles with a number-average particle diameter (D1) obtained in (3) of ±0.1 μm, with the center of the maximum diameter adjusted to the center of the measurement screen, drag within the magnification indication area of the control panel to set the magnification to 10000× (10 k). Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus using autofocus. Then set the magnification to 50000× (50 k); carry out focus adjustment as above using the focus knob and the STIGMA/ALIGNMENT knob; and re-focus using autofocus. Focus by repeating this operation. Here, because the accuracy of the coverage ratio measurement is prone to decline when the observation plane has a large tilt angle, carry out the analysis by making a selection with the least tilt in the surface by making a selection during focus adjustment in which the entire observation plane is simultaneously in focus.

(5) Image Capture

Carry out brightness adjustment using the ABC mode and take a photograph with a size of 640×480 pixels and store. Carry out the analysis described below using this image file. Take one photograph for each magnetic toner particle and obtain images for at least 30 magnetic toner particles.

(6) Image Analysis

The coverage ratio A is calculated in the present invention using the analysis software indicated below by subjecting the image obtained by the above-described procedure to binarization processing. When this is done, the above-described single image is divided into 12 squares and each is analyzed. However, when an inorganic fine particle with a particle diameter greater than or equal to 50 nm is present within a partition, calculation of the coverage ratio A is not performed for this partition.

The analysis conditions with the Image-Pro Plus ver. 5.0 image analysis software are as follows.

Software: Image-ProPlus5.1J

From "measurement" in the tool-bar, select "count/size" and then "option" and set the binarization conditions. Select 8 links in the object extraction option and set smoothing to 0. In addition, preliminary screening, fill vacancies, and envelope are not selected and the "exclusion of boundary line" is set to "none". Select "measurement items" from "measurement" in the tool-bar and enter 2 to $10^7$ for the area screening range.

The coverage ratio is calculated by marking out a square zone. Here, the area (C) of the zone is made 24000 to 26000 pixels. Automatic binarization is performed by "processing"-binarization and the total area (D) of the silica-free zone is calculated.

The coverage ratio a is calculated using the following formula from the area C of the square zone and the total area D of the silica-free zone.

$$\text{coverage ratio } a\ (\%)=100-(D/C\times 100)$$

As noted above, calculation of the coverage ratio a is carried out for at least 30 magnetic toner particles. The average value of all the obtained data is taken to be the coverage ratio A of the present invention.

<The Coefficient of Variation on the Coverage Ratio A>

The coefficient of variation on the coverage ratio A is determined in the present invention as follows. The coefficient of variation on the coverage ratio A is obtained using the following formula letting σ(A) be the standard deviation on all the coverage ratio data used in the calculation of the coverage ratio A described above.

$$\text{coefficient of variation } (\%)=\{\sigma(A)/A\}\times 100$$

<Calculation of the Coverage Ratio B>

The coverage ratio B is calculated by first removing the unfixed inorganic fine particles on the magnetic toner surface and thereafter carrying out the same procedure as followed for the calculation of the coverage ratio A.

(1) Removal of the Unfixed Inorganic Fine Particles

The unfixed inorganic fine particles are removed as described below. The present inventors investigated and then set these removal conditions in order to thoroughly remove the inorganic fine particles other than those embedded in the toner surface.

Figure 7:
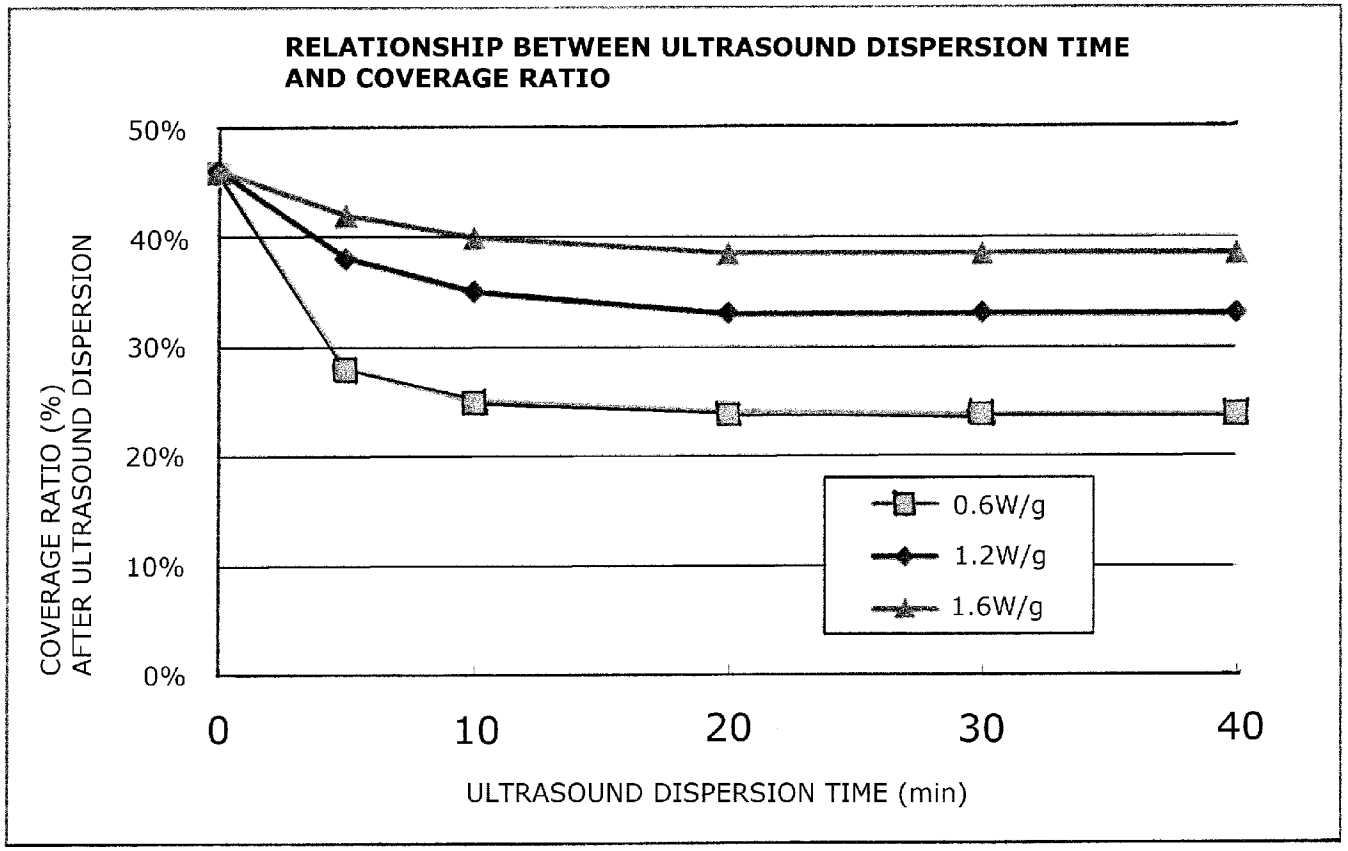
FIG. 7 is a diagram that shows an example of the relationship between the ultrasound dispersion time and the coverage ratio.

As an example, FIG. 7 shows the relationship between the ultrasound dispersion time and the coverage ratio calculated post-ultrasound dispersion, for magnetic toners in which the coverage ratio A was brought to 46% using the apparatus shown in FIG. 4 at three different external addition intensities. FIG. 7 was constructed by calculating, using the same procedure as for the calculation of coverage ratio A as described above, the coverage ratio of a magnetic toner provided by removing the inorganic fine particles by ultrasound dispersion by the method described below and then drying.

FIG. 7 demonstrates that the coverage ratio declines in association with removal of the inorganic fine particles by ultrasound dispersion and that, for all of the external addition intensities, the coverage ratio is brought to an approximately constant value by ultrasound dispersion for 20 minutes. Based on this, ultrasound dispersion for 30 minutes was regarded as providing a thorough removal of the inorganic fine particles other than the inorganic fine particles embedded in the toner surface and the thereby obtained coverage ratio was defined as coverage ratio B.

Considered in greater detail, 16.0 g of water and 4.0 g of Contaminon N (a neutral detergent from Wako Pure Chemical Industries, Ltd., product No. 037-10361) are introduced into a 30 mL glass vial and are thoroughly mixed. 1.50 g of the magnetic toner is introduced into the resulting solution and the magnetic toner is completely submerged by applying a magnet at the bottom. After this, the magnet is moved around in order to condition the magnetic toner to the solution and remove air bubbles.

The tip of a UH-50 ultrasound oscillator (from SMT Co., Ltd., the tip used is a titanium alloy tip with a tip diameter ϕ of 6 mm) is inserted so it is in the center of the vial and resides at a height of 5 mm from the bottom of the vial, and the inorganic fine particles are removed by ultrasound dispersion. After the application of ultrasound for 30 minutes, the entire amount of the magnetic toner is removed and dried. During this time, as little heat as possible is applied while carrying out vacuum drying at not more than 30° C.

(2) Calculation of the Coverage Ratio B

After the drying as described above, the coverage ratio of the magnetic toner is calculated as for the coverage ratio A described above, to obtain the coverage ratio B.

<Method of Measuring the Number-Average Particle Diameter of the Primary Particles of the Inorganic Fine Particles>

The number-average particle diameter of the primary particles of the inorganic fine particles is calculated from the inorganic fine particle image on the magnetic toner surface taken with Hitachi's S-4800 ultrahigh resolution field emission scanning electron microscope (Hitachi High-Technologies Corporation). The conditions for image acquisition with the S-4800 are as follows.

The same steps (1) to (3) as described above in "Calculation of the coverage ratio A" are carried out; focusing is performed by carrying out focus adjustment at a 50000× (50 k) magnification of the magnetic toner surface as in (4); and the brightness is then adjusted using the ABC mode. This is followed by bringing the magnification to 100000× (100 k); performing focus adjustment using the focus knob and STIGMA/ALIGNMENT knobs as in (4); and focusing autofocus. The focus adjustment process is repeated to achieve focus at 100000× (100 k).

After this, the particle diameter is measured on at least 300 inorganic fine particles on the magnetic toner surface and the number-average particle diameter (D1) is determined. Here, because the inorganic fine particles are also present as aggregates, the maximum diameter is determined on what can be identified as the primary particle, and the primary particle number-average particle diameter (D1) is obtained by taking the arithmetic average of the obtained maximum diameters.

<Method for Measuring the Weight-Average Particle Diameter (D4) and the Particle Size Distribution of the Magnetic Toner>

The weight-average particle diameter (D4) of the magnetic toner is calculated as follows. The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added as dispersant about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of about 5%. Measurement is then performed until the number of measured particles reaches 50000.

(7) The measurement data is analyzed by the previously cited software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

<Method of Measuring the Average Circularity of the Magnetic Toner>

The average circularity of the magnetic toner is measured with the "FPIA-3000" (Sysmex Corporation), a flow-type particle image analyzer, using the measurement and analysis conditions from the calibration process.

The specific measurement method is as follows. First, approximately 20 mL of ion-exchanged water from which the solid impurities and so forth have previously been removed is placed in a glass container. To this is added as dispersant about 0.2 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). Approximately 0.02 g of the measurement sample is also added and a dispersion treatment is carried out for 2 minutes using an ultrasound disperser to provide a dispersion for submission to measurement. Cooling is carried out as appropriate during this treatment so as to provide a dispersion temperature of at least 10° C. and no more than 40° C. The ultrasound disperser used here is a benchtop ultrasonic cleaner/disperser that has an oscillation frequency of 50 kHz and an electrical output of 150 W (for example, a "VS-150" from Velvo-Clear Co., Ltd.); a prescribed amount of ion-exchanged water is introduced into the water tank and approximately 2 mL of the aforementioned Contaminon N is also added to the water tank.

The previously cited flow-type particle image analyzer (fitted with a standard objective lens (10×)) is used for the measurement, and Particle Sheath "PSE-900A" (Sysmex Corporation) is used for the sheath solution. The dispersion prepared according to the procedure described above is introduced into the flow-type particle image analyzer and 3000 of the magnetic toner are measured according to total count mode in HPF measurement mode. The average circularity of the magnetic toner is determined with the binarization threshold value during particle analysis set at 85% and the analyzed particle diameter limited to a circle-equivalent diameter of from at least 1.985 μm to less than 39.69 μm.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every two hours after the start of measurement.

In the present invention, the flow-type particle image analyzer used had been calibrated by the Sysmex Corporation and had been issued a calibration certificate by the Sysmex Corporation. The measurements are carried out under the same measurement and analysis conditions as when the calibration certificate was received, with the exception that the analyzed particle diameter is limited to a circle-equivalent diameter of from at least 1.985 μm to less than 39.69 μm.

The "FPIA-3000" flow-type particle image analyzer (Sysmex Corporation) uses a measurement principle based on taking a still image of the flowing particles and performing image analysis. The sample added to the sample chamber is delivered by a sample suction syringe into a flat sheath flow cell. The sample delivered into the flat sheath flow is sandwiched by the sheath liquid to form a flat flow. The sample passing through the flat sheath flow cell is exposed to stroboscopic light at an interval of 1/60 seconds, thus enabling a still image of the flowing particles to be photographed. Moreover, since flat flow is occurring, the photograph is taken under in-focus conditions. The particle image is photographed with a CCD camera; the photographed image is subjected to image processing at an image processing resolution of 512×512 pixels (0.37×0.37 μm per pixel); contour definition is performed on each particle image; and, among other things, the projected area S and the periphery length L are measured on the particle image.

The circle-equivalent diameter and the circularity are then determined using this area S and periphery length L. The circle-equivalent diameter is the diameter of the circle that has the same area as the projected area of the particle image. The circularity is defined as the value provided by dividing the circumference of the circle determined from the circle-equivalent diameter by the periphery length of the particle's projected image and is calculated using the following formula.

$$\text{circularity}=2\times(\pi\times S)^{1/2}/L$$

The circularity is 1.000 when the particle image is a circle, and the value of the circularity declines as the degree of irregularity in the periphery of the particle image increases. After the circularity of each particle has been calculated, 800 are fractionated out in the circularity range of 0.200 to 1.000; the arithmetic average value of the obtained circularities is calculated; and this value is used as the average circularity.

<Method for Measuring the Acid Value of the Resins and Magnetic Toner>

The acid value is determined in the present invention using the following procedure. The basic procedure falls under JIS K 0070.

The measurement is carried out using a potentiometric titration apparatus for the measurement instrumentation. An automatic titration can be used for this titration using an AT-400 (winworkstation) potentiometric titration apparatus and APB-410 piston burette from Kyoto Electronics Manufacturing Co., Ltd.

The instrument is calibrated using a mixed solvent of 120 mL toluene and 30 mL ethanol. 25° C. is used for the measurement temperature.

The sample is prepared by introducing 1.0 g of the magnetic toner or 0.5 g of the resin into a mixed solvent of 120 mL toluene and 30 mL ethanol followed by dispersion for 10 minutes by ultrasound dispersion. A magnetic stirrer is introduced and stirring and dissolution are carried out for about 10 hours while covered. A blank test is performed using an ethanol solution of 0.1 mol/L potassium hydroxide. The amount of ethanolic potassium hydroxide solution used here is designated B (mL). For the above-described sample solution that has been stirred for 10 hours, the magnetic body is magnetically separated and the soluble matter (the test solution from the magnetic toner or the resin) is titrated. The amount of potassium hydroxide solution used here is designated S (mL).

The acid value is calculated with the following formula. The f in this formula is a factor for the KOH. The W in this formula is mass of the sample.

$$\text{acid value (mg KOH/g)}=\{(S-B)\times f\times 5.61\}/W$$

<Method for Measuring the Peak Molecular Weight of the Resins>

The peak molecular weight of the resins is measured using gel permeation chromatography (GPC) under the following conditions.

The column is stabilized in a heated chamber at 40° C., and tetrahydrofuran (THF) is introduced as solvent at a flow rate of 1 mL per minute into the column at this temperature. For the column, a combination of a plurality of commercially available polystyrene gel columns is favorably used to accurately measure the molecular weight range of $1\times10^3$ to $2\times10^6$. Examples here are the combination of Shodex GPC KF-801, 802, 803, 804, 805, 806, 807, and 800P from Showa Denko Kabushiki Kaisha and the combination of TSKgel G1000H(HXL), G2000H(HXL), G3000H(HXL), G4000H (HXL), G5000H(HXL), G6000H(HXL), G7000H(HXL), and TSKguard column from Tosoh Corporation, while a 7-column train of Shodex KF-801, 802, 803, 804, 805, 806, and 807 from Showa Denko Kabushiki Kaisha is preferred.

On the other hand, the resin is dispersed and dissolved in THF and allowed to stand overnight and is then filtered on a sample treatment filter (for example, a MyShoriDisk H-25-2 with a pore size of 0.2 to 0.5 μm (Tosoh Corporation)) and the filtrate is used for the sample. 50 to 200 μL of the THF solution of the resin, which has been adjusted to bring the resin component to 0.5 to 5 mg/mL for the sample concentration, is injected to carry out the measurement. An RI (refractive index) detector is used for the detector.

To measure the molecular weight of the sample, the molecular weight distribution possessed by the sample is calculated from the relationship between the number of counts and the logarithmic value on a calibration curve constructed using several different monodisperse polystyrene standard samples. The standard polystyrene samples used to construct the calibration curve can be exemplified by samples with a molecular weight of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$ from the Pressure Chemical Company or Tosoh Corporation, and standard polystyrene samples at approximately 10 points or more are suitably used.

<Method for Measuring the Dielectric Constant ∈' and Dielectric Loss Tangent (Tan δ) of the Magnetic Toners>

The dielectric characteristics of the magnetic toners are measured using the following methods.

1 g of the magnetic toner is weighed out and subjected to a load of 20 kPa for 1 minute to mold a disk-shaped measurement specimen having a diameter of 25 mm and a thickness of 1.5±0.5 mm.

This measurement specimen is mounted in an ARES (TA Instruments, Inc.) that is equipped with a dielectric constant measurement tool (electrodes) that has a diameter of 25 mm. While a load of 250 g/cm$^2$ is being applied at the measurement temperature of 30° C., the complex dielectric constant at 100 kHz and a temperature of 30° C. is measured using a 4284A Precision LCR meter (Hewlett-Packard Company) and the dielectric constant ∈ and the dielectric loss tangent (tan δ) are calculated from the value measured for the complex dielectric constant.

EXAMPLES

The present invention is described in additional detail through the examples and comparative examples provided below, but the present invention is in no way restricted to these. The % and number of parts in the examples and comparative examples, unless specifically indicated otherwise, are in all instances on a mass basis.

<Binder Resin Production Examples>

(Binder Resin Production Example 1)

The molar ratio for the polyester monomers are as follows.

BPA-PO/BPA-EO/TPA/TMA=50/50/70/12

Here, BPA-PO refers to the 2.2 mole adduct of propylene oxide on bisphenol A; BPA-EO refers to the 2.2 mole adduct of ethylene oxide on bisphenol A; TPA refers to terephthalic acid; and TMA refers to trimellitic anhydride.

Of the starting monomers shown above, the starting monomers other than the TMA and 0.1 mass % tetrabutyl titanate as catalyst were introduced into a flask equipped with a water removal tube, stirring blade, nitrogen inlet tube, and so forth. After carrying out a condensation polymerization for 10 hours at 220° C., the TMA was added and a reaction was carried out at 210° C. until the desired acid value was reached to yield a polyester resin 1 (glass-transition temperature Tg=64° C., acid value=17 mg KOH/g, and peak molecular weight=6200).

(Binder Resin Production Examples 2 to 5)

The peak molecular weight, glass-transition temperature Tg, and acid value were appropriately adjusted by changing the starting monomer ratio of Binder Resin Production Example 1 to obtain the binder resins 2 to 5 shown in Table 1.

(Binder Resin Production Example 6)

300 mass parts of xylene was introduced into a four-neck flask and was heated under reflux and a mixture of 80 mass parts of styrene, 20 mass parts of n-butyl acrylate, and 1.5 mass parts of di-tert-butyl peroxide was added dropwise over 5 hours to obtain a low molecular weight polymer (L−1) solution.

180 mass parts of degassed water and 20 mass parts of a 2 mass % aqueous polyvinyl alcohol solution were introduced into a four-neck flask; a liquid mixture of 78 mass parts of styrene, 22 mass parts of n-butyl acrylate, 0.005 mass parts of divinylbenzene, and 0.09 mass parts of 2,2-bis(4,4-di-tert-butylperoxycyclohexyl)propane (10-hour half-life temperature: 92° C.) was thereafter added; and stirring was carried out to yield a suspension. After the interior of the flask had been thoroughly replaced with nitrogen, the temperature was raised to 85° C. and polymerization was carried out; after holding for 24 hours, 0.1 mass parts of benzoyl peroxide (10-hour half-life temperature: 72° C.) was added and holding was continued for another 12 hours to finish the polymerization of a high molecular weight polymer (H−1).

25 mass parts of the high molecular weight polymer (H−1) was introduced into 300 mass parts of the low molecular weight polymer (L−1) solution and thorough mixing was carried out under reflux. This was followed by the distillative removal of the organic solvent to yield a binder resin 6 (glass-transition temperature Tg=63° C., acid value=0 mg KOH/g, peak molecular weight=15000), which was a styrene-acrylic resin.

<Magnetic Toner Particle Production Example 1> binder resin 1 shown in Table 1 100.0 mass parts (peak molecular weight: 6200, glass-transition temperature Tg: 64° C., acid value: 17 mg KOH/g)

wax 5.0 mass parts (low molecular weight polyethylene, melting point: 102° C., number-average molecular weight Mn: 850)

magnetic body 95.0 mass parts (composition: $Fe_3O_4$, shape: spherical, primary particle number-average particle diameter: 0.21 μm, magnetic characteristics for 795.8 kA/m: $H_c$=5.5 kA/m, $\sigma_s$=84.0 $Am^2/kg$, and $\sigma_r$=6.4 $Am^2/kg$)

T-77 charge control agent 1.0 mass part (Hodogaya Chemical Co., Ltd.)

The raw materials listed above were preliminarily mixed using an FM10C Henschel mixer (Mitsui Miike Chemical Engineering Machinery Co., Ltd.) and were then kneaded with a twin-screw kneader/extruder (PCM-30, Ikegai Ironworks Corporation) set at a rotation rate of 200 rpm with the set temperature being adjusted to provide a direct temperature in the vicinity of the outlet for the kneaded material of 155° C.

The resulting melt-kneaded material was cooled; the cooled melt-kneaded material was coarsely pulverized with a cutter mill; the resulting coarsely pulverized material was finely pulverized using a Turbo Mill T-250 (Turbo Kogyo Co., Ltd.) at a feed rate of 20 kg/hr with the air temperature adjusted to provide an exhaust gas temperature of 38° C.; and classification was performed using a Coanda effect-based multifraction classifier to obtain a magnetic toner particle 1 having a weight-average particle diameter (D4) of 7.8 μm. The production conditions for magnetic toner particle 1 are shown in Table 2.

TABLE 1

| | Type of resin | Peak molecular weight | Tg (° C.) | Acid value (mg KOH/g) |
|---|---|---|---|---|
| Binder resin 1 | Polyester resin | 6200 | 64 | 17 |
| Binder resin 2 | Polyester resin | 6500 | 65 | 8 |
| Binder resin 3 | Polyester resin | 6000 | 63 | 50 |
| Binder resin 4 | Polyester resin | 6600 | 66 | 5 |
| Binder resin 5 | Polyester resin | 5800 | 62 | 54 |
| Binder resin 6 | Styrene-acrylic resin | 15000 | 63 | 0 |

TABLE 2

| | Bnder resin | Magnetic body content (mass parts) | Direct temperature of the kneaded material (° C.) | Exhaust gas temperature during fine pulverization (° C.) | Weight-average particle diameter D4 (μm) |
|---|---|---|---|---|---|
| Magnetic toner particle 1 | Binder resin 1 | 95 | 155 | 38 | 7.8 |
| Magnetic toner particle 2 | Binder resin 2 | 95 | 155 | 39 | 7.8 |
| Magnetic toner particle 3 | Binder resin 3 | 95 | 155 | 40 | 7.7 |
| Magnetic toner particle 4 | Binder resin 4 | 95 | 155 | 39 | 7.8 |
| Magnetic toner particle 5 | Binder resin 5 | 95 | 155 | 40 | 7.9 |
| Magnetic toner particle 6 | Binder resin 1 | 60 | 155 | 38 | 8.1 |
| Magnetic toner particle 7 | Binder resin 1 | 105 | 155 | 37 | 7.6 |
| Magnetic toner particle 8 | Binder resin 1 | 55 | 155 | 38 | 8.0 |
| Magnetic toner particle 9 | Binder resin 1 | 120 | 155 | 39 | 7.0 |
| Magnetic toner particle 10 | Binder resin 1 | 95 | 155 | 44 | 7.7 |
| Magnetic toner particle 11 | Binder resin 1 | 95 | 155 | 48 | 7.7 |
| Magnetic toner particle 12 | Binder resin 6 | 95 | 165 | 38 | 7.8 |
| Magnetic toner particle 13 | Binder resin 1/6 | 95 | 165 | 38 | 7.7 |
| Magnetic toner particle 14 | Binder resin 3 | 105 | 155 | 40 | 7.6 |
| Magnetic toner particle 15 | Binder resin 1 | 105 | 145 | 40 | 7.6 |
| Magnetic toner particle 16 | Binder resin 1 | 95 | 155 | 38 | 7.7 |
| Magnetic toner particle 17 | Binder resin 1 | 95 | 155 | 38 | 7.8 |

<Magnetic Toner Production Example 1>

An external addition and mixing process was carried out using the apparatus shown in FIG. 4 on the magnetic toner particle 1 provided by Magnetic Toner Particle Production Example 1.

In this example, the diameter of the inner circumference of the main casing 1 of the apparatus shown in FIG. 4 was 130 mm; the apparatus used had a volume for the processing space 9 of $2.0\times10^{-3}$ $m^3$; the rated power for the drive member 8 was 5.5 kW; and the stirring member 3 had the shape given in FIG. 5. The overlap width d in FIG. 5 between the stirring member 3*a* and the stirring member 3*b* was 0.25 D with respect to the maximum width D of the stirring member 3, and the clearance between the stirring member 3 and the inner circumference of the main casing 1 was 3.0 mm.

100 mass parts (500 g) of magnetic toner particles 1 and 2.00 mass parts of the silica fine particles 1 described below were introduced into the apparatus shown in FIG. 4 having the apparatus structure described above.

Silica fine particles 1 were obtained by treating 100 mass parts of a silica with a BET specific surface area of 130 $m^2/g$ and a primary particle number-average particle diameter (D1) of 16 nm with 10 mass parts hexamethyldisilazane and then with 10 mass parts dimethylsilicone oil.

A pre-mixing was carried out after the introduction of the magnetic toner particles and the silica fine particles in order to uniformly mix the magnetic toner particles and the silica fine particles. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 1.0 W/g (drive member 8 rotation rate of 1800 rpm). The conditions for the external addition and mixing process are shown in Table 3.

After the external addition and mixing process, the coarse particles and so forth were removed using a circular vibrating screen equipped with a screen having a diameter of 500 mm and an aperture of 75 μm to obtain magnetic toner 1. A value of 18 nm was obtained when magnetic toner 1 was submitted to magnification and observation with a scanning electron microscope and the number-average particle diameter of the primary particles of the silica fine particles on the magnetic toner surface was measured. The external addition conditions and properties of magnetic toner 1 are shown in Table 3 and Table 4, respectively.

<Magnetic Toner Production Example 2>

A magnetic toner 2 was obtained by following the same procedure as in Magnetic Toner Production Example 1, with the exception that silica fine particles 2 were used in place of the silica fine particles 1. Silica fine particles 2 were obtained by performing the same surface treatment as with silica fine particles 1, but on a silica that had a BET specific area of 200 $m^2/g$ and a primary particle number-average particle diameter (D1) of 12 nm. A value of 14 nm was obtained when magnetic toner 2 was submitted to magnification and observation with a scanning electron microscope and the number-average particle diameter of the primary particles of the silica fine particles on the magnetic toner surface was measured. The external addition conditions and properties of magnetic toner 2 are shown in Table 3 and Table 4.

<Magnetic Toner Production Example 3>

A magnetic toner 3 was obtained by following the same procedure as in Magnetic Toner Production Example 1, with the exception that silica fine particles 3 were used in place of the silica fine particles 1. Silica fine particles 3 were obtained by performing the same surface treatment as with silica fine particles 1, but on a silica that had a BET specific area of 90 $m^2/g$ and a primary particle number-average particle diameter (D1) of 25 nm. A value of 28 nm was obtained when magnetic toner 3 was submitted to magnification and observation with a scanning electron microscope and the number-average particle diameter of the primary particles of the silica fine particles on the magnetic toner surface was measured. The external addition conditions and properties of magnetic toner 3 are shown in Table 3 and Table 4.

<Magnetic Toner Particle Production Examples 2 to 15>

Magnetic toner particles 2 to 15 were obtained by following the same procedure as in Magnetic Toner Particle Production Example 1, but changing to the binder resins and magnetic body contents shown in Table 2 and controlling the direct temperature in the vicinity of the outlet for the kneaded material and the exhaust gas temperature during fine pulverization to the settings in Table 2. The production conditions for and properties of magnetic toner particles 2 to 15 are shown in Table 2.

In the case of magnetic toner particle 13, production was carried out using both binder resin 1 and binder resin 6 by using a mixture of 20 mass parts of binder resin 1 and 80 mass parts of binder resin 6 for a total of 100 mass parts.

In addition, production was carried out to provide a higher average circularity for the magnetic toner by controlling the exhaust temperature of the Turbo Mill T-250 (Turbo Kogyo Co., Ltd.) to a somewhat high 44° C. during fine pulverization in the case of magnetic toner particle 10 and by setting to an even higher 48° C. during fine pulverization in the case of magnetic toner particle 11.

<Magnetic Toner Particle Production Example 16>

External addition prior to a hot wind treatment was performed by mixing 100 mass parts of magnetic toner particles 1 using an FM10C Henschel mixer (Mitsui Miike Chemical Engineering Machinery Co., Ltd.) with 0.5 mass parts of the silica fine particles used in the external addition and mixing process of Magnetic Toner Production Example 1. The external addition conditions here were a rotation rate of 3000 rpm and a processing time of 2 minutes.

Then, after being subjected to this external addition prior to a hot wind treatment, the magnetic toner particles were subjected to surface modification using a Meteorainbow (Nippon Pneumatic Mfg. Co., Ltd.), which is a device that carries out the surface modification of toner particles using a hot wind blast. The surface modification conditions were a raw material feed rate of 2 kg/hr, a hot wind flow rate of 700 L/min, and a hot wind ejection temperature of 300° C. Magnetic toner particles 16 were obtained by carrying out this hot wind treatment.

<Magnetic Toner Particle Production Example 17>

Magnetic toner particle 17 was obtained by following the same procedure as in Magnetic Toner Particle Production Example 16, but in this case using 1.5 mass parts for the amount of addition of the silica fine particles in the external addition prior to the hot wind treatment in Magnetic Toner Particle Production Example 16.

<Magnetic Toner Production Examples 4, 5, and 8 to 31 and Comparative Magnetic Toner Production Examples 1 to 23>

Magnetic toners 4, 5, and 8 to 31 and comparative magnetic toners 1 to 23 were obtained using the magnetic toner particles shown in Table 3 in Magnetic Toner Production Example 1 in place of magnetic toner particle 1 and by performing respective external addition processing using the external addition recipes, external addition apparatuses, and external addition conditions shown in Table 3. The properties of magnetic toners 4, 5, and 8 to 31 and comparative magnetic toners 1 to 23 are shown in Table 4.

Anatase titanium oxide fine particles (BET specific surface area: 80 $m^2/g$, primary particle number-average particle diameter (D1): 15 nm, treated with 12 mass % isobutyltrimethoxysilane) were used for the titania fine particles referenced in Table 3 and alumina fine particles (BET specific surface area: 80 $m^2/g$, primary particle number-average particle diameter (D1): 17 nm, treated with 10 mass % isobutyltrimethoxysilane) were used for the alumina fine particles referenced in Table 3.

Table 3 gives the proportion (mass %) of silica fine particles for the addition of titania fine particles and/or alumina fine particles in addition to silica fine particles.

For magnetic toners 26 and 27 and comparative magnetic toners 19 to 23, pre-mixing was not performed and the external addition and mixing process was carried out immediately after introduction.

The hybridizer referenced in Table 3 is the Hybridizer Model 5 (Nara Machinery Co., Ltd.), and the Henschel mixer referenced in Table 3 is the FM10C (Mitsui Miike Chemical Engineering Machinery Co., Ltd.).

<Magnetic Toner Production Example 6>

The external addition and mixing process was performed according to the following procedure using the same apparatus as in Magnetic Toner Production Example 1.

As shown in Table 3, the silica fine particle 1 (2.00 mass parts) added in Magnetic Toner Production Example 1 was changed to silica fine particle 1 (1.70 mass parts) and titania fine particles (0.30 mass parts).

First, 100 mass parts of magnetic toner particles 1, 0.70 mass parts of the silica fine particles, and 0.30 mass parts of the titania fine particles were introduced and the same pre-mixing as in Magnetic Toner Production Example 1 was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining silica fine particles (1.00 mass part with reference to 100 mass parts of magnetic toner particle 1) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes.

After the external addition and mixing process, the coarse particles and so forth were removed using a circular vibrating screen as in Magnetic Toner Production Example 1 to obtain magnetic toner 6. The external addition conditions for magnetic toner 6 are given in Table 3 and the properties of magnetic toner 6 are given in Table 4.

<Magnetic Toner Production Example 7>

The external addition and mixing process was performed according to the following procedure using the same apparatus as in Magnetic Toner Production Example 1.

As shown in Table 3, the silica fine particle 1 (2.00 mass parts) added in Magnetic Toner Production Example 1 was changed to silica fine particle 1 (1.70 mass parts) and titania fine particles (0.30 mass parts).

First, 100 mass parts of magnetic toner particles 1 and 1.70 mass parts of the silica fine particles were introduced and the same pre-mixing as in Magnetic Toner Production Example 1 was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining titania fine particles (0.30 mass parts with reference to 100 mass parts of magnetic toner particle 1) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes.

After the external addition and mixing process, the coarse particles and so forth were removed using a circular vibrating screen as in Magnetic Toner Production Example 1 to obtain magnetic toner 7. The external addition conditions for magnetic toner 7 are given in Table 3 and the properties of magnetic toner 7 are given in Table 4.

<Magnetic Toner Production Example 32>

A magnetic toner 32 was obtained proceeding as in Magnetic Toner Production Example 1, with the exception that the addition of 2.00 mass parts of silica fine particles 1 to 100 mass parts (500 g) of magnetic toner particles 1 was changed to 1.80 mass parts. The external addition conditions for magnetic toner 32 are shown in Table 3 and the properties of magnetic toner 32 are shown in Table 4.

<Magnetic Toner Production Example 33>

A magnetic toner 33 was obtained proceeding as in Magnetic Toner Production Example 3, with the exception that 1.80 mass parts of silica fine particles 3 was added to the 100 mass parts (500 g) of magnetic toner particles 1. The external addition conditions for magnetic toner 33 are shown in Table 3 and the properties of magnetic toner 33 are shown in Table 4.

<Comparative Magnetic Toner Production Example 24>

A comparative magnetic toner 24 was obtained by following the same procedure as in Magnetic Toner Production Example 1, with the exception that silica fine particles 4 were used in place of the silica fine particles 1. Silica fine particles 4 were obtained by performing the same surface treatment as with silica fine particles 1, but on a silica that had a BET specific area of 30 $m^2/g$ and a primary particle number-average particle diameter (D1) of 51 nm. A value of 53 nm was obtained when comparative magnetic toner 24 was submitted to magnification and observation with a scanning electron microscope and the number-average particle diameter of the primary particles of the silica fine particles on the magnetic toner surface was measured. The external addition conditions for magnetic toner 24 are shown in Table 3 and the properties of magnetic toner 24 are shown in Table 4.

TABLE 3

| Magnetic toner | Magnetic toner particle | Silica fine particles (mass parts) | Titania fine particles (mass parts) | Alumina fine particles (mass parts) | Content of silica fine particles (mass %) | Content of silica fine particles in the fixed inorganic fine particles (mass %) |
|---|---|---|---|---|---|---|
| Magnetic toner 1 | Magnetic toner particle 1 | 2.00 | — | — | 100 | 100 |
| Magnetic toner 2 | Magnetic toner particle 1 | 2.00 | — | — | 100 | 100 |
| Magnetic toner 3 | Magnetic toner particle 1 | 2.00 | — | — | 100 | 100 |
| Magnetic toner 4 | Magnetic toner particle 1 | 1.70 | 0.30 | — | 85 | 85 |
| Magnetic toner 5 | Magnetic toner particle 1 | 1.70 | 0.15 | 0.15 | 85 | 85 |
| Magnetic toner 6 | Magnetic toner particle 1 | 1.70 | 0.30 | — | 85 | 80 |
| Magnetic toner 7 | Magnetic toner particle 1 | 1.70 | 0.30 | — | 85 | 90 |
| Magnetic toner 8 | Magnetic toner particle 1 | 1.50 | — | — | 100 | 100 |
| Magnetic toner 9 | Magnetic toner particle 1 | 1.28 | 0.22 | — | 85 | 85 |
| Magnetic toner 10 | Magnetic toner particle 1 | 1.28 | 0.12 | 0.10 | 85 | 85 |
| Magnetic toner 11 | Magnetic toner particle 1 | 2.60 | — | — | 100 | 100 |
| Magnetic toner 12 | Magnetic toner particle 1 | 2.25 | 0.35 | — | 87 | 87 |
| Magnetic toner 13 | Magnetic toner particle 1 | 2.25 | 0.20 | 0.15 | 87 | 87 |
| Magnetic toner 14 | Magnetic toner particle 1 | 1.50 | — | — | 100 | 100 |
| Magnetic toner 15 | Magnetic toner particle 1 | 1.50 | — | — | 100 | 100 |
| Magnetic toner 16 | Magnetic toner particle 1 | 2.60 | — | — | 100 | 100 |
| Magnetic toner 17 | Magnetic toner particle 1 | 2.60 | — | — | 100 | 100 |
| Magnetic toner 18 | Magnetic toner particle 2 | 2.00 | — | — | 100 | 100 |
| Magnetic toner 19 | Magnetic toner particle 3 | 2.00 | — | — | 100 | 100 |
| Magnetic toner 20 | Magnetic toner particle 4 | 2.00 | — | — | 100 | 100 |
| Magnetic toner 21 | Magnetic toner particle 5 | 2.00 | — | — | 100 | 100 |
| Magnetic toner 22 | Magnetic toner particle 6 | 2.00 | — | — | 100 | 100 |
| Magnetic toner 23 | Magnetic toner particle 7 | 2.00 | — | — | 100 | 100 |
| Magnetic toner 24 | Magnetic toner particle 8 | 2.00 | — | — | 100 | 100 |
| Magnetic toner 25 | Magnetic toner particle 9 | 2.00 | — | — | 100 | 100 |
| Magnetic toner 26 | Magnetic toner particle 1 | 2.00 | — | — | 100 | 100 |
| Magnetic toner 27 | Magnetic toner particle 5 | 2.00 | — | — | 100 | 100 |
| Magnetic toner 28 | Magnetic toner particle 10 | 2.00 | — | — | 100 | 100 |
| Magnetic toner 29 | Magnetic toner particle 11 | 2.00 | — | — | 100 | 100 |
| Magnetic toner 30 | Magnetic toner particle 5 | 2.00 | — | — | 100 | 100 |
| Magnetic toner 31 | Magnetic toner particle 5 | 2.00 | — | — | 100 | 100 |
| Magnetic toner 32 | Magnetic toner particle 1 | 1.80 | — | — | 100 | 100 |
| Magnetic toner 33 | Magnetic toner particle 1 | 1.80 | — | — | 100 | 100 |
| Comparative magnetic toner 1 | Magnetic toner particle 1 | 1.50 | — | — | 100 | 100 |
| Comparative magnetic toner 2 | Magnetic toner particle 1 | 1.50 | — | — | 100 | 100 |
| Comparative magnetic toner 3 | Magnetic toner particle 1 | 2.60 | — | — | 100 | 100 |
| Comparative magnetic toner 4 | Magnetic toner particle 1 | 2.60 | — | — | 100 | 100 |
| Comparative magnetic toner 5 | Magnetic toner particle 1 | 1.50 | — | — | 100 | 100 |
| Comparative magnetic toner 6 | Magnetic toner particle 1 | 1.50 | — | — | 100 | 100 |
| Comparative magnetic toner 7 | Magnetic toner particle 16 | 1.00 | — | — | 100 | 100 |
| Comparative magnetic toner 8 | Magnetic toner particle 16 | 2.00 | — | — | 100 | 100 |
| Comparative magnetic toner 9 | Magnetic toner particle 17 | 1.00 | — | — | 100 | 100 |
| Comparative magnetic toner 10 | Magnetic toner particle 17 | 2.00 | — | — | 100 | 100 |
| Comparative magnetic toner 11 | Magnetic toner particle 1 | 1.60 | 0.40 | — | 80 | 80 |
| Comparative magnetic toner 12 | Magnetic toner particle 1 | 1.60 | 0.20 | 0.20 | 80 | 80 |
| Comparative magnetic toner 13 | Magnetic toner particle 12 | 2.00 | — | — | 100 | 100 |
| Comparative magnetic toner 14 | Magnetic toner particle 13 | 2.00 | — | — | 100 | 100 |
| Comparative magnetic toner 15 | Magnetic toner particle 12 | 2.00 | — | — | 100 | 100 |
| Comparative magnetic toner 16 | Magnetic toner particle 14 | 2.00 | — | — | 100 | 100 |
| Comparative magnetic toner 17 | Magnetic toner particle 14 | 2.00 | — | — | 100 | 100 |
| Comparative magnetic toner 18 | Magnetic toner particle 15 | 2.00 | — | — | 100 | 100 |
| Comparative magnetic toner 19 | Magnetic toner particle 1 | 1.50 | — | — | 100 | 100 |
| Comparative magnetic toner 20 | Magnetic toner particle 1 | 1.20 | — | — | 100 | 100 |
| Comparative magnetic toner 21 | Magnetic toner particle 1 | 3.10 | — | — | 100 | 100 |
| Comparative magnetic toner 22 | Magnetic toner particle 1 | 2.60 | — | — | 100 | 100 |
| Comparative magnetic toner 23 | Magnetic toner particle 1 | 1.50 | — | — | 100 | 100 |
| Comparative magnetic toner 24 | Magnetic toner particle 1 | 2.00 | — | — | 100 | 100 |

| Magnetic toner | Magnetic toner particle | External addition apparatus | Operating conditions for the external addition apparatus | Operating time by the external addition apparatus |
|---|---|---|---|---|
| Magnetic toner 1 | Magnetic toner particle 1 | Apparatus of FIG. 4 | 1.0 W/g (1800 rpm) | 5 min |
| Magnetic toner 2 | Magnetic toner particle 1 | Apparatus of FIG. 4 | 1.0 W/g (1800 rpm) | 5 min |
| Magnetic toner 3 | Magnetic toner particle 1 | Apparatus of FIG. 4 | 1.0 W/g (1800 rpm) | 5 min |
| Magnetic toner 4 | Magnetic toner particle 1 | Apparatus of FIG. 4 | 1.0 W/g (1800 rpm) | 5 min |
| Magnetic toner 5 | Magnetic toner particle 1 | Apparatus of FIG. 4 | 1.0 W/g (1800 rpm) | 5 min |
| Magnetic toner 6 | Magnetic toner particle 1 | Apparatus of FIG. 4 | 1.0 W/g (1800 rpm) | 5 min |
| Magnetic toner 7 | Magnetic toner particle 1 | Apparatus of FIG. 4 | 1.0 W/g (1800 rpm) | 5 min |

TABLE 3-continued

| | | | | |
|---|---|---|---|---|
| Magnetic toner 8 | Magnetic toner particle 1 | Apparatus of FIG. 4 | 1.0 W/g (1800 rpm) | 5 min |
| Magnetic toner 9 | Magnetic toner particle 1 | Apparatus of FIG. 4 | 1.0 W/g (1800 rpm) | 5 min |
| Magnetic toner 10 | Magnetic toner particle 1 | Apparatus of FIG. 4 | 1.0 W/g (1800 rpm) | 5 min |
| Magnetic toner 11 | Magnetic toner particle 1 | Apparatus of FIG. 4 | 1.0 W/g (1800 rpm) | 5 min |
| Magnetic toner 12 | Magnetic toner particle 1 | Apparatus of FIG. 4 | 1.0 W/g (1800 rpm) | 5 min |
| Magnetic toner 13 | Magnetic toner particle 1 | Apparatus of FIG. 4 | 1.0 W/g (1800 rpm) | 5 min |
| Magnetic toner 14 | Magnetic toner particle 1 | Apparatus of FIG. 4 | 1.6 W/g (2500 rpm) | 5 min |
| Magnetic toner 15 | Magnetic toner particle 1 | Apparatus of FIG. 4 | 0.6 W/g (1400 rpm) | 5 min |
| Magnetic toner 16 | Magnetic toner particle 1 | Apparatus of FIG. 4 | 1.6 W/g (2500 rpm) | 5 min |
| Magnetic toner 17 | Magnetic toner particle 1 | Apparatus of FIG. 4 | 0.6 W/g (1400 rpm) | 5 min |
| Magnetic toner 18 | Magnetic toner particle 2 | Apparatus of FIG. 4 | 1.0 W/g (1800 rpm) | 5 min |
| Magnetic toner 19 | Magnetic toner particle 3 | Apparatus of FIG. 4 | 1.0 W/g (1800 rpm) | 5 min |
| Magnetic toner 20 | Magnetic toner particle 4 | Apparatus of FIG. 4 | 1.0 W/g (1800 rpm) | 5 min |
| Magnetic toner 21 | Magnetic toner particle 5 | Apparatus of FIG. 4 | 1.0 W/g (1800 rpm) | 5 min |
| Magnetic toner 22 | Magnetic toner particle 6 | Apparatus of FIG. 4 | 1.0 W/g (1800 rpm) | 5 min |
| Magnetic toner 23 | Magnetic toner particle 7 | Apparatus of FIG. 4 | 1.0 W/g (1800 rpm) | 5 min |
| Magnetic toner 24 | Magnetic toner particle 8 | Apparatus of FIG. 4 | 1.0 W/g (1800 rpm) | 5 min |
| Magnetic toner 25 | Magnetic toner particle 9 | Apparatus of FIG. 4 | 1.0 W/g (1800 rpm) | 5 min |
| Magnetic toner 26 | Magnetic toner particle 1 | Apparatus of FIG. 4 | No pre-mixing<br>1.0 W/g (1800 rpm) | 5 min |
| Magnetic toner 27 | Magnetic toner particle 5 | Apparatus of FIG. 4 | No pre-mixing<br>1.0 W/g (1800 rpm) | 3 min |
| Magnetic toner 28 | Magnetic toner particle 10 | Apparatus of FIG. 4 | 1.0 W/g (1800 rpm) | 5 min |
| Magnetic toner 29 | Magnetic toner particle 11 | Apparatus of FIG. 4 | 1.0 W/g (1800 rpm) | 5 min |
| Magnetic toner 30 | Magnetic toner particle 5 | Hybridizer | 6000 rpm | 5 min |
| Magnetic toner 31 | Magnetic toner particle 5 | Hybridizer | 7000 rpm | 8 min |
| Magnetic toner 32 | Magnetic toner particle 1 | Apparatus of FIG. 4 | 1.0 W/g (1800 rpm) | 5 min |
| Magnetic toner 33 | Magnetic toner particle 1 | Apparatus of FIG. 4 | 1.0 W/g (1800 rpm) | 5 min |
| Comparative magnetic toner 1 | Magnetic toner particle 1 | Henschel mixer | 3000 rpm | 2 min |
| Comparative magnetic toner 2 | Magnetic toner particle 1 | Henschel mixer | 4000 rpm | 5 min |
| Comparative magnetic toner 3 | Magnetic toner particle 1 | Henschel mixer | 3000 rpm | 2 min |
| Comparative magnetic toner 4 | Magnetic toner particle 1 | Henschel mixer | 4000 rpm | 5 min |
| Comparative magnetic toner 5 | Magnetic toner particle 1 | Hybridizer | 7000 rpm | 8 min |
| Comparative magnetic toner 6 | Magnetic toner particle 1 | Hybridizer | 7000 rpm | 8 min |
| Comparative magnetic toner 7 | Magnetic toner particle 16 | Henschel mixer | 4000 rpm | 2 min |
| Comparative magnetic toner 8 | Magnetic toner particle 16 | Henschel mixer | 4000 rpm | 2 min |
| Comparative magnetic toner 9 | Magnetic toner particle 17 | Henschel mixer | 4000 rpm | 2 min |
| Comparative magnetic toner 10 | Magnetic toner particle 17 | Henschel mixer | 4000 rpm | 2 min |
| Comparative magnetic toner 11 | Magnetic toner particle 1 | Apparatus of FIG. 4 | 1.0 W/g (1800 rpm) | 5 min |
| Comparative magnetic toner 12 | Magnetic toner particle 1 | Apparatus of FIG. 4 | 1.0 W/g (1800 rpm) | 5 min |
| Comparative magnetic toner 13 | Magnetic toner particle 12 | Hybridizer | 6000 rpm | 5 min |
| Comparative magnetic toner 14 | Magnetic toner particle 13 | Hybridizer | 6000 rpm | 5 min |
| Comparative magnetic toner 15 | Magnetic toner particle 12 | Apparatus of FIG. 4 | 1.0 W/g (1800 rpm) | 5 min |
| Comparative magnetic toner 16 | Magnetic toner particle 14 | Apparatus of FIG. 4 | 1.0 W/g (1800 rpm) | 5 min |
| Comparative magnetic toner 17 | Magnetic toner particle 14 | Hybridizer | 6000 rpm | 5 min |
| Comparative magnetic toner 18 | Magnetic toner particle 15 | Hybridizer | 6000 rpm | 5 min |
| Comparative magnetic toner 19 | Magnetic toner particle 1 | Apparatus of FIG. 4 | No pre-mixing<br>0.6 W/g (1400 rpm) | 3 min |
| Comparative magnetic toner 20 | Magnetic toner particle 1 | Apparatus of FIG. 4 | No pre-mixing<br>0.6 W/g (1400 rpm) | 3 min |
| Comparative magnetic toner 21 | Magnetic toner particle 1 | Apparatus of FIG. 4 | No pre-mixing<br>1.6 W/g (2500 rpm) | 3 min |
| Comparative magnetic toner 22 | Magnetic toner particle 1 | Apparatus of FIG. 4 | No pre-mixing<br>0.6 W/g (1400 rpm) | 3 min |
| Comparative magnetic toner 23 | Magnetic toner particle 1 | Apparatus of FIG. 4 | No pre-mixing<br>2.2 W/g (3300 rpm) | 5 min |
| Comparative magnetic toner 24 | Magnetic toner particle 1 | Apparatus of FIG. 4 | 1.0 W/g (1800 rpm) | 5 min |

TABLE 4

| Magnetic toner | Magnetic toner particle | Coverage ratio A (%) | B/A (—) | Coefficient of variation on coverage ratio A (%) | Dielectric constant ε' (pF/m) | Dielectric loss tangent tanδ (—) | Magnetic body content (mass %) | Acid value (mg KOH/g) | Average circularity (—) |
|---|---|---|---|---|---|---|---|---|---|
| Magnetic toner 1 | Magnetic toner particle 1 | 55.5 | 0.70 | 6.5 | 34.0 | 7.9 | 46 | 15 | 0.943 |
| Magnetic toner 2 | Magnetic toner particle 1 | 58.2 | 0.73 | 6.2 | 34.0 | 7.9 | 46 | 15 | 0.943 |
| Magnetic toner 3 | Magnetic toner particle 1 | 50.5 | 0.65 | 8.1 | 34.0 | 7.9 | 46 | 15 | 0.943 |
| Magnetic toner 4 | Magnetic toner particle 1 | 54.8 | 0.68 | 6.8 | 33.8 | 7.7 | 46 | 15 | 0.943 |
| Magnetic toner 5 | Magnetic toner particle 1 | 54.3 | 0.67 | 6.8 | 33.9 | 7.8 | 46 | 15 | 0.943 |
| Magnetic toner 6 | Magnetic toner particle 1 | 54.2 | 0.66 | 6.8 | 33.8 | 7.7 | 46 | 15 | 0.943 |
| Magnetic toner 7 | Magnetic toner particle 1 | 54.9 | 0.69 | 6.8 | 33.8 | 7.7 | 46 | 15 | 0.943 |
| Magnetic toner 8 | Magnetic toner particle 1 | 45.8 | 0.72 | 6.7 | 33.8 | 7.7 | 47 | 15 | 0.943 |
| Magnetic toner 9 | Magnetic toner particle 1 | 45.5 | 0.71 | 6.8 | 33.6 | 7.7 | 47 | 15 | 0.943 |
| Magnetic toner 10 | Magnetic toner particle 1 | 45.4 | 0.71 | 6.9 | 33.7 | 7.6 | 47 | 15 | 0.943 |
| Magnetic toner 11 | Magnetic toner particle 1 | 69.2 | 0.68 | 6.3 | 34.2 | 8.0 | 46 | 15 | 0.943 |

TABLE 4-continued

| Magnetic toner | Magnetic toner particle | Coverage ratio A (%) | B/A (—) | Coefficient of variation on coverage ratio A (%) | Dielectric constant ε' (pF/m) | Dielectric loss tangent tanδ (—) | Magnetic body content (mass %) | Acid value (mg KOH/g) | Average circularity (—) |
|---|---|---|---|---|---|---|---|---|---|
| Magnetic toner 12 | Magnetic toner particle 1 | 68.7 | 0.68 | 6.4 | 34.0 | 7.8 | 46 | 15 | 0.943 |
| Magnetic toner 13 | Magnetic toner particle 1 | 67.8 | 0.67 | 6.6 | 34.1 | 7.9 | 46 | 15 | 0.943 |
| Magnetic toner 14 | Magnetic toner particle 1 | 45.8 | 0.84 | 6.3 | 33.6 | 7.7 | 47 | 15 | 0.943 |
| Magnetic toner 15 | Magnetic toner particle 1 | 45.8 | 0.52 | 7.1 | 33.6 | 7.7 | 47 | 15 | 0.943 |
| Magnetic toner 16 | Magnetic toner particle 1 | 69.2 | 0.83 | 5.9 | 34.2 | 8.0 | 46 | 15 | 0.943 |
| Magnetic toner 17 | Magnetic toner particle 1 | 69.2 | 0.52 | 6.7 | 34.2 | 8.0 | 46 | 15 | 0.943 |
| Magnetic toner 18 | Magnetic toner particle 2 | 54.4 | 0.69 | 6.7 | 33.0 | 8.5 | 46 | 5 | 0.945 |
| Magnetic toner 19 | Magnetic toner particle 3 | 55.8 | 0.71 | 6.8 | 37.0 | 8.1 | 46 | 49 | 0.946 |
| Magnetic toner 20 | Magnetic toner particle 4 | 55.2 | 0.68 | 6.6 | 32.0 | 8.8 | 46 | 4 | 0.945 |
| Magnetic toner 21 | Magnetic toner particle 5 | 55.4 | 0.71 | 6.8 | 38.0 | 8.9 | 46 | 52 | 0.947 |
| Magnetic toner 22 | Magnetic toner particle 6 | 53.2 | 0.67 | 7.3 | 32.5 | 6.5 | 35 | 15 | 0.943 |
| Magnetic toner 23 | Magnetic toner particle 7 | 56.4 | 0.71 | 6.7 | 38.5 | 8.6 | 49 | 15 | 0.942 |
| Magnetic toner 24 | Magnetic toner particle 8 | 52.3 | 0.67 | 7.5 | 31.5 | 6.0 | 33 | 15 | 0.944 |
| Magnetic toner 25 | Magnetic toner particle 9 | 56.8 | 0.72 | 6.6 | 39.0 | 8.9 | 52 | 15 | 0.945 |
| Magnetic toner 26 | Magnetic toner particle 1 | 52.4 | 0.70 | 9.8 | 34.0 | 7.9 | 46 | 15 | 0.943 |
| Magnetic toner 27 | Magnetic toner particle 5 | 51.6 | 0.66 | 10.5 | 38.0 | 8.9 | 46 | 52 | 0.947 |
| Magnetic toner 28 | Magnetic toner particle 10 | 55.8 | 0.71 | 7.1 | 33.8 | 7.9 | 46 | 15 | 0.953 |
| Magnetic toner 29 | Magnetic toner particle 11 | 56.2 | 0.72 | 7.2 | 33.9 | 7.8 | 46 | 15 | 0.957 |
| Magnetic toner 30 | Magnetic toner particle 5 | 52.6 | 0.52 | 12.0 | 38.2 | 8.9 | 46 | 52 | 0.947 |
| Magnetic toner 31 | Magnetic toner particle 5 | 52.8 | 0.70 | 11.4 | 38.3 | 8.9 | 46 | 52 | 0.947 |
| Magnetic toner 32 | Magnetic toner particle 1 | 50.5 | 0.70 | 6.6 | 34.0 | 7.9 | 46 | 15 | 0.943 |
| Magnetic toner 33 | Magnetic toner particle 1 | 47.2 | 0.64 | 9.3 | 34.0 | 7.9 | 46 | 15 | 0.943 |
| Comparative magnetic toner 1 | Magnetic toner particle 1 | 36.5 | 0.41 | 18.0 | 33.5 | 7.6 | 47 | 15 | 0.943 |
| Comparative magnetic toner 2 | Magnetic toner particle 1 | 38.2 | 0.43 | 18.0 | 33.5 | 7.6 | 47 | 15 | 0.943 |
| Comparative magnetic toner 3 | Magnetic toner particle 1 | 50.2 | 0.35 | 13.2 | 33.9 | 7.9 | 46 | 15 | 0.943 |
| Comparative magnetic toner 4 | Magnetic toner particle 1 | 52.4 | 0.36 | 12.1 | 33.9 | 7.9 | 46 | 15 | 0.943 |
| Comparative magnetic toner 5 | Magnetic toner particle 1 | 43.5 | 0.82 | 13.5 | 33.6 | 7.7 | 47 | 15 | 0.943 |
| Comparative magnetic toner 6 | Magnetic toner particle 1 | 44.5 | 0.86 | 12.5 | 33.6 | 7.7 | 47 | 15 | 0.943 |
| Comparative magnetic toner 7 | Magnetic toner particle 16 | 42.8 | 0.47 | 14.8 | 33.6 | 7.7 | 47 | 15 | 0.970 |
| Comparative magnetic toner 8 | Magnetic toner particle 16 | 54.8 | 0.48 | 14.9 | 33.9 | 7.8 | 46 | 15 | 0.970 |
| Comparative magnetic toner 9 | Magnetic toner particle 17 | 63.2 | 0.87 | 13.2 | 34.0 | 7.9 | 46 | 15 | 0.970 |
| Comparative magnetic toner 10 | Magnetic toner particle 17 | 71.5 | 0.83 | 13.1 | 34.3 | 8.1 | 46 | 15 | 0.970 |
| Comparative magnetic toner 11 | Magnetic toner particle 1 | 54.0 | 0.68 | 8.0 | 33.4 | 7.6 | 46 | 15 | 0.943 |
| Comparative magnetic toner 12 | Magnetic toner particle 1 | 53.5 | 0.66 | 8.5 | 33.6 | 7.7 | 46 | 15 | 0.943 |
| Comparative magnetic toner 13 | Magnetic toner particle 12 | 54.8 | 0.52 | 12.2 | 27.0 | 3.3 | 46 | — | 0.945 |
| Comparative magnetic toner 14 | Magnetic toner particle 13 | 55.1 | 0.53 | 12.2 | 29.5 | 4.2 | 46 | 15 | 0.946 |
| Comparative magnetic toner 15 | Magnetic toner particle 12 | 55.4 | 0.71 | 6.6 | 27.0 | 7.8 | 46 | — | 0.945 |
| Comparative magnetic toner 16 | Magnetic toner particle 14 | 55.6 | 0.72 | 6.7 | 41.2 | 7.8 | 49 | 49 | 0.947 |
| Comparative magnetic toner 17 | Magnetic toner particle 14 | 55.8 | 0.52 | 12.3 | 41.2 | 8.8 | 49 | 49 | 0.947 |
| Comparative magnetic toner 18 | Magnetic toner particle 15 | 55.7 | 0.51 | 12.4 | 39.0 | 9.3 | 49 | 15 | 0.945 |
| Comparative magnetic toner 19 | Magnetic toner particle 1 | 45.8 | 0.48 | 12.5 | 33.8 | 7.9 | 47 | 15 | 0.943 |
| Comparative magnetic toner 20 | Magnetic toner particle 1 | 43.2 | 0.53 | 13.0 | 33.9 | 7.8 | 47 | 15 | 0.943 |
| Comparative magnetic toner 21 | Magnetic toner particle 1 | 72.5 | 0.54 | 11.5 | 34.0 | 7.9 | 46 | 15 | 0.943 |
| Comparative magnetic toner 22 | Magnetic toner particle 1 | 68.2 | 0.48 | 11.9 | 33.9 | 8.0 | 46 | 15 | 0.943 |
| Comparative magnetic toner 23 | Magnetic toner particle 1 | 46.7 | 0.88 | 11.8 | 34.0 | 7.9 | 47 | 15 | 0.943 |
| Comparative magnetic toner 24 | Magnetic toner particle 1 | 35.8 | 0.49 | 10.6 | 34.0 | 7.9 | 46 | 15 | 0.943 |

Example 1

(The Image-Forming Apparatus)

The image-forming apparatus was an LBP-3100 (Canon, Inc.), which was equipped with a small-diameter developing sleeve that had a diameter of 10 mm; its printing speed had been modified from 16 sheets/minute to 20 sheets/minute. The contact pressure by the cleaning blade had also been modified from 4 kgf/m to 9 kgf/m. In an image-forming apparatus equipped with a small-diameter developing sleeve, the durability can be rigorously evaluated by changing the printing speed to 20 sheets/minute and the streaks can be rigorously evaluated by raising the cleaning blade pressure.

Using this modified apparatus and magnetic toner 1, a 3000-sheet image printing test was performed in one-sheet intermittent mode of horizontal lines at a print percentage of 1% in a high-temperature, high-humidity environment (32.5° C./80% RH). After the 3000 sheets had been printed, standing was carried out for 1 day in the high-temperature, high-humidity environment and additional printing was then performed.

According to the results, a high density was obtained before and after the durability test and an image was obtained that presented little fogging in the nonimage areas. In addition, streaks were suppressed even after the 3000-print durability test and an excellent image could be obtained. The results of the evaluation are shown in Table 5.

The evaluation methods and associated scales used in the evaluations carried out in the examples of the present invention and comparative examples are described below.

<Image Density>

For the image density, a solid image area was formed and the density of this solid image was measured with a MacBeth reflection densitometer (MacBeth Corporation).

The following scale was used to evaluate the reflection density of the solid image at the start of the durability test (evaluation 1).

A: very good (greater than or equal to 1.45)

B: good (less than 1.45 and greater than or equal to 1.40)

C: average (less than 1.40 and greater than or equal to 1.35)

D: poor (less than 1.35)

The following scale was used to evaluate the image density after the latter half of the durability test (evaluation 2).

A better result is indicated by a smaller difference between the reflection density of the solid image at the start of the durability test and the reflection density of the solid image after the 3000-sheet durability test.

A: very good (less than 0.05)

B: good (less than 0.10 and greater than or equal to 0.05)

C: average (less than 0.15 and greater than or equal to 0.10)

D: poor (greater than or equal to 0.15)

<Fogging>

A white image was output and its reflectance was measured using a REFLECTMETER MODEL TC-6DS from Tokyo Denshoku Co., Ltd. On the other hand, the reflectance was also similarly measured on the transfer paper (standard paper) prior to formation of the white image. A green filter was used as the filter. The fogging was calculated using the following formula from the reflectance before output of the white image and the reflectance after output of the white image.

fogging (%)=reflectance (%) of the standard paper−reflectance (%) of the white image sample The scale for evaluating the fogging is below.

A: very good (less than 1.2%)

B: good (less than 2.0% and greater than or equal to 1.2%)

C: average (less than 3.0% and greater than or equal to 2.0%)

D: poor (greater than or equal to 3.0%)

<Streaks>

With regard to streaks, standing was carried out for 1 day after a 3000-sheet durability test; 5 half-tone image prints were then made; and the extent of the streaks was visually evaluated using the following scale.

A: no streaks were produced

B: very light streaks were produced

C: light streaks were produced

D: significant production of streaks

Examples 2 to 33 and Comparative Examples 1 to 24

Toner evaluations were carried out under the same conditions as in Example 1 using magnetic toners 2 to 33 and comparative magnetic toners 1 to 24 for the magnetic toner. The results of the evaluations are shown in Table 5. With comparative magnetic toner 21, there was a very substantial amount of released silica fine particles on the developing sleeve and image defects in the form of vertical streaks were produced.

TABLE 5-1

| | | Evaluation 1 (starting density) | Evaluation 2 (extent of density decline) | Evaluation 3 (fogging) | Evaluation 4 (streaks) |
|---|---|---|---|---|---|
| Example 1 | Magnetic toner 1 | A (1.48) | A (0.03) | A (0.6) | A |
| Example 2 | Magnetic toner 2 | A (1.48) | A (0.03) | A (0.6) | A |
| Example 3 | Magnetic toner 3 | A (1.47) | A (0.04) | A (0.8) | A |
| Example 4 | Magnetic toner 4 | A (1.46) | B (0.07) | A (0.7) | A |
| Example 5 | Magnetic toner 5 | A (1.47) | A (0.04) | B (1.4) | A |
| Example 6 | Magnetic toner 6 | A (1.45) | B (0.07) | A (0.7) | A |
| Example 7 | Magnetic toner 7 | A (1.47) | B (0.06) | A (0.6) | A |
| Example 8 | Magnetic toner 8 | A (1.45) | A (0.04) | A (0.7) | A |
| Example 9 | Magnetic toner 9 | B (1.44) | B (0.07) | A (0.8) | A |
| Example 10 | Magnetic toner 10 | A (1.45) | A (0.04) | B (1.5) | A |
| Example 11 | Magnetic toner 11 | A (1.47) | A (0.02) | A (0.8) | A |
| Example 12 | Magnetic toner 12 | A (1.45) | B (0.06) | A (0.9) | A |
| Example 13 | Magnetic toner 13 | A (1.46) | A (0.04) | B (1.6) | A |
| Example 14 | Magnetic toner 14 | A (1.45) | B (0.07) | A (0.7) | A |
| Example 15 | Magnetic toner 15 | B (1.44) | A (0.04) | A (0.7) | B |
| Example 16 | Magnetic toner 16 | A (1.45) | A (0.04) | A (0.8) | B |
| Example 17 | Magnetic toner 17 | A (1.46) | A (0.03) | B (1.2) | A |
| Example 18 | Magnetic toner 18 | A (1.46) | A (0.04) | B (1.2) | A |
| Example 19 | Magnetic toner 19 | A (1.45) | B (0.07) | A (0.7) | A |
| Example 20 | Magnetic toner 20 | A (1.45) | A (0.04) | B (1.7) | A |
| Example 21 | Magnetic toner 21 | B (1.42) | B (0.09) | A (0.6) | A |
| Example 22 | Magnetic toner 22 | A (1.46) | A (0.04) | B (1.6) | A |
| Example 23 | Magnetic toner 23 | A (1.45) | B (0.07) | A (0.5) | A |
| Example 24 | Magnetic toner 24 | A (1.45) | A (0.04) | B (1.9) | A |
| Example 25 | Magnetic toner 25 | B (1.42) | B (0.09) | A (0.4) | A |
| Example 26 | Magnetic toner 26 | A (1.47) | A (0.04) | A (0.7) | A |
| Example 27 | Magnetic toner 27 | B (1.42) | B (0.08) | A (1.1) | C |
| Example 28 | Magnetic toner 28 | A (1.47) | A (0.04) | A (0.8) | A |
| Example 29 | Magnetic toner 29 | A (1.46) | A (0.04) | B (1.3) | B |
| Example 30 | Magnetic toner 30 | B (1.43) | B (0.08) | A (0.9) | C |
| Example 31 | Magnetic toner 31 | B (1.43) | B (0.08) | A (0.9) | C |
| Example 32 | Magnetic toner 32 | A (1.47) | A (0.03) | A (0.7) | A |
| Example 33 | Magnetic toner 33 | A (1.46) | A (0.04) | A (0.8) | A |

TABLE 5-2

| | | Evaluation 1 (starting density) | Evaluation 2 (extent of density decline) | Evaluation 3 (fogging) | Evaluation 4 (streaks) |
|---|---|---|---|---|---|
| Comparative Example 1 | Comparative magnetic toner 1 | D (1.33) | C (0.13) | B (1.5) | D |
| Comparative Example 2 | Comparative magnetic toner 2 | D (1.34) | C (0.13) | B (1.3) | D |
| Comparative Example 3 | Comparative magnetic toner 3 | C (1.38) | B (0.08) | B (1.5) | D |

TABLE 5-2-continued

| | | Evaluation 1 (starting density) | Evaluation 2 (extent of density decline) | Evaluation 3 (fogging) | Evaluation 4 (streaks) |
|---|---|---|---|---|---|
| Comparative Example 4 | Comparative magnetic toner 4 | C (1.38) | B (0.09) | B (1.5) | D |
| Comparative Example 5 | Comparative magnetic toner 5 | C (1.36) | C (0.12) | B (1.3) | D |
| Comparative Example 6 | Comparative magnetic toner 6 | C (1.36) | D (0.15) | B (1.3) | D |
| Comparative Example 7 | Comparative magnetic toner 7 | C (1.39) | C (0.14) | B (1.7) | D |
| Comparative Example 8 | Comparative magnetic toner 8 | B (1.41) | C (0.13) | B (1.8) | D |
| Comparative Example 9 | Comparative magnetic toner 9 | B (1.42) | B (0.08) | B (1.9) | D |
| Comparative Example 10 | Comparative magnetic toner 10 | B (1.43) | B (0.07) | C (2.1) | D |
| Comparative Example 11 | Comparative magnetic toner 11 | C (1.39) | C (0.14) | B (1.8) | D |
| Comparative Example 12 | Comparative magnetic toner 12 | B (1.42) | B (0.08) | C (2.6) | D |
| Comparative Example 13 | Comparative magnetic toner 13 | B (1.42) | C (0.10) | C (2.4) | D |
| Comparative Example 14 | Comparative magnetic toner 14 | B (1.42) | B (0.08) | C (2.2) | D |
| Comparative Example 15 | Comparative magnetic toner 15 | B (1.43) | C (0.10) | C (2.2) | D |
| Comparative Example 16 | Comparative magnetic toner 16 | B (1.43) | C (0.11) | B (1.3) | D |
| Comparative Example 17 | Comparative magnetic toner 17 | B (1.41) | C (0.12) | B (1.4) | D |
| Comparative Example 18 | Comparative magnetic toner 18 | B (1.42) | C (0.14) | C (2.4) | D |
| Comparative Example 19 | Comparative magnetic toner 19 | B (1.41) | B (0.09) | B (1.8) | D |
| Comparative Example 20 | Comparative magnetic toner 20 | B (1.41) | B (0.08) | B (1.7) | D |
| Comparative Example 21 | Comparative magnetic toner 21 | C (1.36) | D (0.15) | D (3.2) | D |
| Comparative Example 22 | Comparative magnetic toner 22 | B (1.42) | B (0.09) | C (2.2) | D |
| Comparative Example 23 | Comparative magnetic toner 23 | C (1.37) | D (0.16) | C (2.1) | D |
| Comparative Example 24 | Comparative magnetic toner 24 | D (1.31) | C (0.12) | C (2.1) | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-286201, filed on Dec. 27, 2011, which is hereby incorporated by reference herein in its entirety.

REFERENCE SIGNS LIST

1: main casing
2: rotating member
3, 3*a*, 3*b*: stirring member
4: jacket
5: raw material inlet port
6: product discharge port
7: center shaft
8: drive member
9: processing space
10: end surface of the rotating member
11: direction of rotation
12: back direction
13: forward direction
16: raw material inlet port inner piece
17: product discharge port inner piece
d: distance showing the overlapping portion of the stirring members
D: stirring member width
100: electrostatic latent image-bearing member (photosensitive member)
102: toner-carrying member
103: developing blade
114: transfer member (transfer charging roller)
116: cleaner container
117: charging member (charging roller)
121: laser generator (latent image-forming means, photoexposure apparatus)
123: laser
124: pick-up roller
125: transport belt
126: fixing unit
140: developing device
141: stirring member

The invention claimed is:

1. A magnetic toner comprising magnetic toner particles comprising a binder resin and a magnetic body, and inorganic fine particles present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed on the magnetic toner particles' surface, the magnetic toner has a coverage ratio A of at least 45.0% and not more than 70.0% and a ratio [coverage ratio B/coverage ratio A] of the coverage ratio B to the coverage ratio A of at least 0.50 and not more than 0.85, and wherein the magnetic toner has a dielectric constant $\in'$, at a frequency of 100 kHz and a temperature of 30° C., of at least 30.0 pF/m and not more than 40.0 pF/m and has a dielectric loss tangent (tan δ) of not more than $9.0\times10^{-3}$.

2. The magnetic toner according to claim 1, wherein the binder resin comprises a polyester resin.

3. The magnetic toner according to claim 1, wherein the coefficient of variation on the coverage ratio A is not more than 10.0%.

4. The magnetic toner according to claim 1, wherein the magnetic toner comprises from at least 35 mass % to not more than 50 mass % of a magnetic body.

5. The magnetic toner according to claim 1, wherein an acid value, measured using a potentiometric titration apparatus, of a soluble matter obtained by dissolving the magnetic toner in a mixed solvent of toluene and ethanol is from at least 5 mg KOH/g to not more than 50 mg KOH/g.

6. The magnetic toner according to claim 1, wherein the magnetic toner has an average circularity of from at least 0.935 to not more than 0.955.

* * * * *